United States Patent [19]

Sivilotti et al.

[11] 4,190,103

[45] Feb. 26, 1980

[54] CONTINUOUS CASTING OF METAL STRIP BETWEEN MOVING BELTS

[75] Inventors: Olivo G. Sivilotti; David E. Steer; Thomas A. C. Stock, all of Kingston, Canada

[73] Assignee: Alcan Research and Development Limited, Montreal, Canada

[21] Appl. No.: 834,969

[22] Filed: Sep. 20, 1977

Related U.S. Application Data

[62] Division of Ser. No. 568,320, Apr. 15, 1975, Pat. No. 4,061,178.

[51] Int. Cl.[2] ..... B22D 27/02; F28F 25/06

[52] U.S. Cl. ..... 165/120; 164/432; 164/433

[58] Field of Search ..... 165/120, 121, 90–92; 164/89, 348, 90, 91, 87, 432, 443, 448, 433

[56] References Cited

U.S. PATENT DOCUMENTS

| | | | |
|---|---|---|---|
| 3,250,315 | 5/1966 | Osborne et al. | 165/120 |
| 3,331,429 | 7/1967 | Harrison et al. | 164/348 |
| 3,654,989 | 4/1972 | Meier et al. | 164/348 |
| 3,732,917 | 5/1973 | Deubel | 165/120 |
| 4,002,197 | 1/1977 | Hazelett et al. | 164/432 |

*Primary Examiner*—Samuel Scott
*Assistant Examiner*—Theophil W. Streule, Jr.
*Attorney, Agent, or Firm*—Cooper, Dunham, Clark, Griffin & Moran

[57] ABSTRACT

For supporting and cooling the reverse surfaces of belts in apparatus for continuously casting metal strip between such belts, means enclosing the reverse surface of a belt includes a multiplicity of guiding faces that are distributed closely both crosswise and lengthwise of the belt to define an intended belt path, and that have nozzle openings through which liquid coolant is projected against the belt, rapidly flowing out in a layer over the guiding face and being withdrawn at localities close to all of the guiding faces. The belt, which may be forced toward the faces to stabilize it in its desired path, thus rests on a layer of rapidly moving liquid coolant, which affords efficient heat removal and an essentially complete liquid bearing, such apparatus and procedure being also deemed applicable to cooling other surfaces. The high velocity coolant layer can be extended around part of the curved path followed by the belts returning to enter the mold space; thus or otherwise a liquid bearing can be provided along this return belt path approaching the mold entrance, avoiding large pulleys that interfere with the use of effective cooling structure there. The guide-faced nozzle elements along the mold path can be individually mounted and limit-loaded toward the belt so as to yield to local excess of outward force by the belt, for instance as caused by solidified metal.

2 Claims, 15 Drawing Figures

Fig. 4.
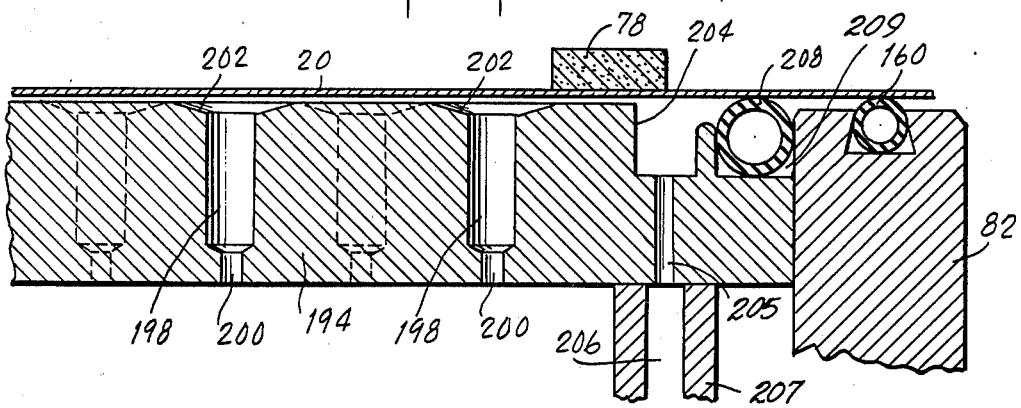
Fig. 5.
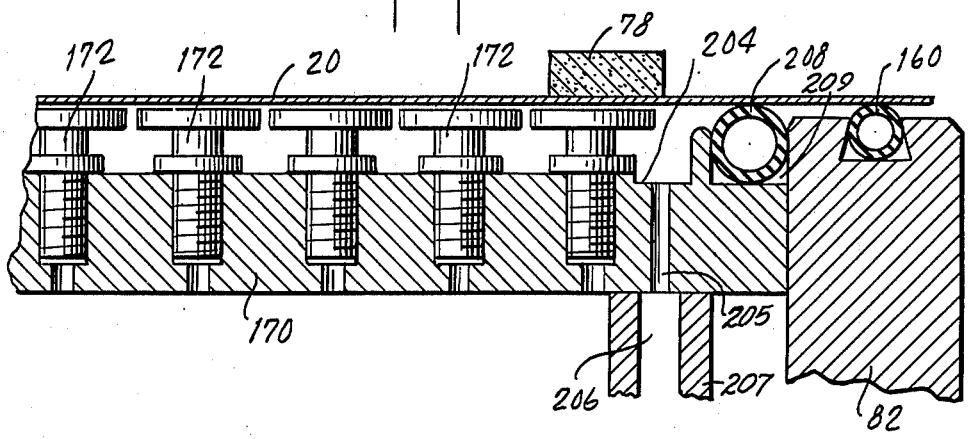
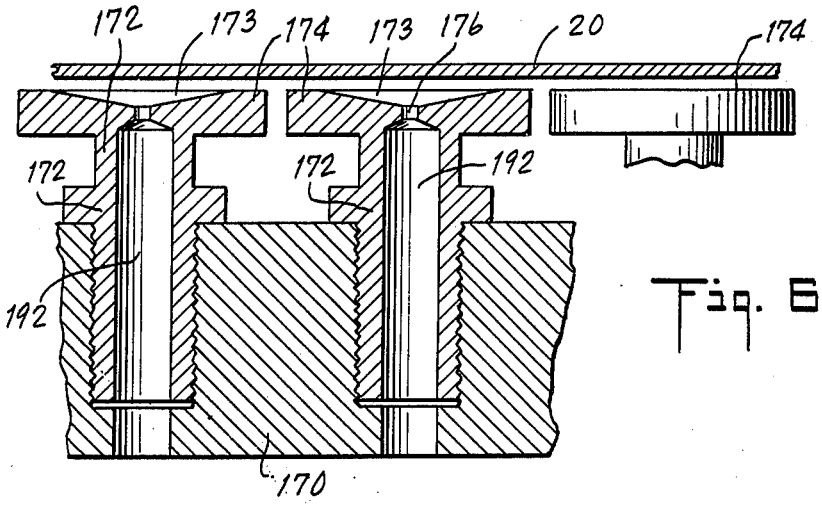
Fig. 6.

Fig. 7.
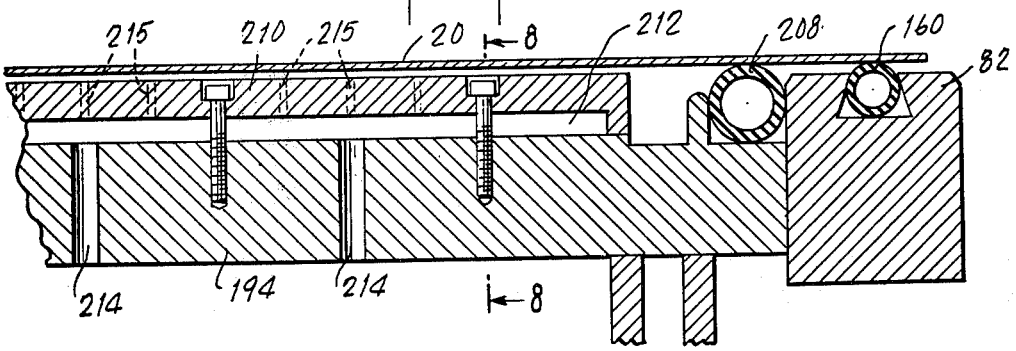
Fig. 8.
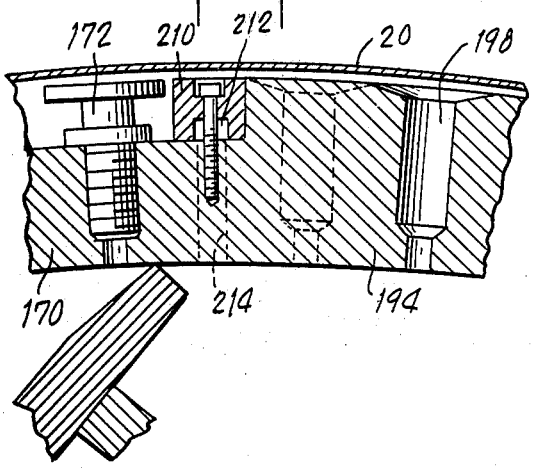
Fig. 10.
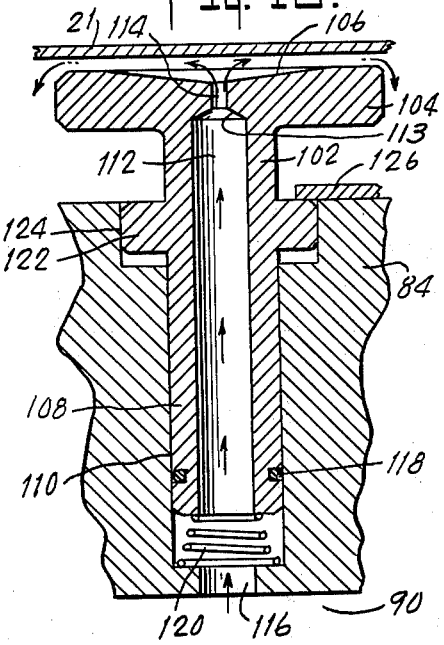
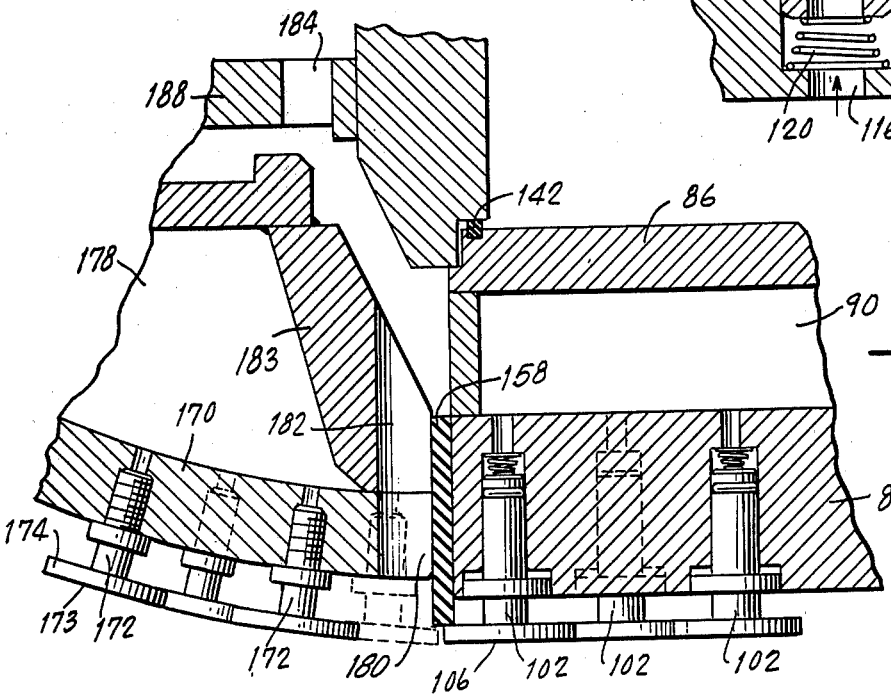
Fig. 9.

11
158
84
108
100
96
92
106
126
122
21
13
78
160
164
168
148
82
154
152

CONTINUOUS CASTING OF METAL STRIP BETWEEN MOVING BELTS

This is a division of application Ser. No. 568,320 filed Apr. 15, 1975, now U.S. Pat. No. 4,061,178 granted Dec. 6, 1979.

BACKGROUND OF THE INVENTION

This invention relates primarily to the continuous casting of metals in the form of strip, and in one particular sense it relates to methods and apparatus for casting metals such as aluminum (including aluminum alloys) and zinc, and other metals which melt at moderate or low temperatures, between a pair of moving surfaces, which are conveniently constituted by flexible, heat-conducting bands or belts that have conventionally been metal belts in twin-belt casters of this sort.

In another sense, the invention is generally concerned with cooling metallic or like surfaces of various kinds, including surfaces which are moving continuously in a predetermined path, e.g. such as a moving belt in a casting machine or a work roll of a rolling mill. Another example of this category of surfaces is a metal strip requiring cooling such as to remove heat generated in a previous rolling pass during multi-pass rolling operations or to quench it during thermal treatment in metallurgical operations. In all of these cases, one chief object of the invention is to attain efficient provision of coolant liquid, having complete and unobstructed contact with the entirety of the moving surface, such liquid being continuously circulated as an essentially confined layer in rapid flow on the surface so as to afford great superiority of cooling effect.

A further and more specific aspect of the invention resides in apparatus for cooling, guiding and supporting a continuous metal belt or the like in a casting apparatus, whereby the belt is supported in effect without rubbing frictional contact while it is maintained in a precise, desired path, and whereby the belt is nevertheless permitted to yield to any small extent necessary as to accommodate slight irregularities in the surface of the solidifying strip or to coact most closely with change in volume of the strip as it solidifies, or otherwise to provide improved dimensional control of the cast strip with efficient cooling for its proper solidification. Thus a paramount object is to yield a desired, highly uniform strip product having excellent internal and surface characteristics.

The continuous casting of metal, and indeed particularly the casting of aluminum and similar light metals, to which the present invention is very preferably (although not in some of its more general aspects necessarily) directed, has been under development for many years. Such development has been represented by the use, for a number of purposes, of belt-casting apparatus wherein a pair of endless metal belts are caused to travel in substantially parallel paths so as to define a mold space between them, closed at its sides by suitable edge dams. The molten metal is supplied to one end of the space and discharged from between the moving belts at the exit end, as a fully solidified strip which would desirably be of any predetermined thickness in the range from the thickness of slab to relatively thin plate or sheet. Such choice of product thickness, however, has been difficult or impossible to attain in many cases, especially for the thinner gauges. Arrangements have been provided for cooling the reverse faces of the belts, to remove heat as necessary for solidifying the metal. Provision has also been made for guiding the belts along paths that taper somewhat toward each other from the entrance end to the exit, i.e. so that the mold space becomes narrower to accommodate shrinkage of the solidifying metal.

Among various prior construction for removing heat from the metal in the mold space, one type of casting apparatus has included means for projecting cooling water at a very small angle along, indeed practically parallel to, the reverse face of each belt at successive places along the belt path, with coacting means for scooping part of the water from such surface at successive localities. The belt is also engaged by guiding disks or rollers between or around which the water flows.

In another belt casting apparatus, the cooling means has involved a multiplicity of jet elements projecting water substantially perpendicularly against the reverse face of each belt. That arrangement advantageously also involves an enclosure or casing at and around such reverse face and the jet means, so that water fills the enclosure and in effect covers the surface while the jets are projected through the contained body of water. In coaction with these cooling instrumentalities, a multiplicity of belt supports are provided in this prior apparatus, being distributed in close spacing throughout the belt path, with the provision of cooperating means for exerting positive force on the belt to draw it toward the supports. In this way, there was assurance of a conformity of the belt with a desired path defined by the faces of the supports.

A particularly effective concept for the latter purpose was to provide a lower fluid pressure at the reverse face of each belt, e.g. a subatmospheric pressure, such that the force urging the belt outward is created by substantial pressure difference, for the desired retention of the belt in place against the supports as it moves along. Thus in a practical embodiment of the above-mentioned apparatus, the belt has been drawn against the faces of the closely spaced supports by subatmospheric pressure in the water-filled housing. An alternative arrangement was to provide magnetic means, acting through ferromagnetic supports on a ferromagnetic belt, to hold the belt in the desired path.

Other and earlier ways of cooling casting belts have simply involved directing water against the belt at many places, but without special means to afford coverage of as much of the surface as possible with rapidly flowing water. Earlier belt-casting apparatus also usually included supporting elements, such as rollers or disks, intended to engage the reverse face of the moving belt; reliance was placed on the head of the molten metal or the tension of the belt, or both, to hold the belt against the supports. In some cases, the shaft of each support roll or set of wheels that extends across the belt path has been mounted with some resilient means such as springs at its ends (i.e. outside the edges of the belt), the purpose being to urge the transverse rotatable assembly, as a whole, against the belt and thereby theoretically to keep the belt in proper engagement with the solidifying metal, but it has become apparent that such arrangements may fail to achieve desired dimensional accuracy or uniformity of the casting.

As explained above, the prior apparatus of more recent development wherein positive force, independent of the effect of metal in the casting cavity, is exerted on the belt to draw it toward the supports, e.g. by providing suction in the coolant space which positively pulls the belt against the closely spaced supporting elements, has represented a significant departure in positionally stabilizing the belts, i.e. affording a new mode of stabilization which can in effect be employed in the new cooling and guiding means of the present invention.

It is not only important to maintain a high rate of heat removal from the reverse face of the belt, but it is also of great importance to achieve superior cooling while maintaining exact positional stability of such belt, in optimum contact with the solidifying and indeed solidified strip surface, while keeping each belt in a path that accurately determines the desired accuracy and uniformity of strip gauge. In other words, basic criteria of cooling and guiding means for a casting belt have now been found to include not only a high rate of heat removal and accurate positioning of the belts to produce a uniform, accurately dimensional cast strip, but as complete contact as possible between the belt and the solidifying, surface-solidified and finally solidified metal throughout the mold space so as to achieve true efficiency of cooling and avoidance of local breakout of liquid metal at the strip surface, local remelting or uneven progress of solidification, any of which can occur by local gaps between the belt and solidified skin or shell of the metal so as to interfere with heat removal. A primary object of the present invention is to satisfy these criteria, insuring accurately cast strip with a good, uniform surface and good, uniform microstructure of the metal.

A related, important aspect of the present invention is directed to the attainment of greater casting speed while achieving the above desired results in production of satisfactorily cast strip. In particular, a special object is to eliminate, essentially, the frictional engagement of the belts with supporting elements or the like, and to eliminate their attendant wear, and at the same time to increase the casting speed by eliminating the interference which such elements may cause in the attainment of rapid and thorough cooling of the reverse surfaces of the belts by water flow. A special improvement of the present invention thus resides in attaining substantially greater casting speeds than heretofore possible, while maintaining very satisfactory cooling and avoiding problems of belt travel and stability. Alternatively, the invention can be considered as achieving faster cooling and as fast a casting rate, or faster, than heretofore possible, while attaining superior uniformity of internal and surface characteristics. As will be further appreciated, improvements in all of these respects permit readier casting of alloys which have heretofore been deemed difficult because of differential solidification and different freezing temperatures of subcombinations of alloying elements, i.e. circumstances which with poor cooling are conducive to breakout of molten metal or non-uniformity of solidified microstructure. In other words, the present invention is believed to attain faster casting and the ability to cast a greater variety, for example, of aluminum and indeed other alloys, by a continuous process.

SUMMARY OF THE INVENTION

To these and other ends, the invention, considered in its general surface-cooling aspects, embraces novel arrangements for providing an unobstructed layer of moving liquid coolant, e.g. water, over essentially the entirety of the moving surface to be cooled, by directing the coolant to such surface from many localities in a structure that constitutes, in effect, a closely adjacent surface. Such coolant layer is essentially confined to a preferably small thickness between the moving and adjacent surfaces.

A particularly important feature involves means whereby the liquid coolant under pressure is projected on the moving surface as a distributed multiplicity of jets directed at a substantially large angle to the surface, e.g. perpendicularly, and in such fashion that the liquid then rapidly flows outward from each jet, constituting the described coolant layer. For special utility the arrangement of the cooling means constitutes the liquid layer, advantageously in high velocity flow and in continuous withdrawal through regions of the adjacent surface between successive jet openings, as a separator between the surfaces so that when the moving surface is a strip or band, the band may (to any extent desired) be guided, or indeed supported, through the layer, by the adjacent surface. Thus no mechanical parts need intervene, to create uncooled areas, or to cause friction with the band.

As presently contemplated for surface cooling, practical embodiments of the invention comprise a multiplicity of guiding faces which lie in a common path or surface and in effect define the desired path of the moving surface to be cooled, or otherwise constitute a surface conforming with such desired path. These faces of the cooling structure, closely distributed throughout the area where cooling is to be effected, are each centrally apertured to provide a jet nozzle, and are suitably configured, each face preferably being centrally slightly concave. The liquid coolant is directed under pressure through each aperture against the moving surface. Means are advantageously provided whereby the region embracing these coolant-projecting nozzles (or each region occupied by a group of many nozzles) is enclosed around the moving surface, preferably so that the enclosed space is substantially filled with liquid, at least including the liquid layer which covers the moving surface and which occupies the space between such surface and the surface constituted by the nozzle faces except for possible cavitation pockets between such layer and the nozzle face concavities. There are suitable passage means for supplying liquid under pressure to all of the jets, and cooperating means to remove liquid from the enclosure, advantageously so that liquid is drawn from the region of the belt through small openings between the nozzle faces.

The foregoing nozzle structure may be constituted by a multiplicity of individual elements, each having the defined centrally slightly concave face and the central jet aperture, and all of them being distributed in close spacing throughout the area to be cooled. There are preferably a large multiplicity of these guide-faced nozzle elements, including at least several rows extending across the path of the moving surface, with at least several in each row; indeed very preferably there are, in effect, many such transverse rows, each having a great many such nozzle elements, for efficient realization of the superior cooling action.

In belt-casting machines of the sort to which a major aspect of the invention is directed, the continuous belts, e.g. metal belts, are arranged so that for receiving and solidifying the liquid metal they follow substantially parallel paths (that may include some convergence or taper), i.e. thus defining the mold space or casting cavity between them. The belts follow return paths, with roller or other curved supports and usually suitable driving means, through regions respectively above and below the mold space. Metal is introduced in molten state into the mold space at one end, travels with the belts, and is delivered or withdrawn at the other end as solidified, cast strip. The term "strip" is used generically herein (unless otherwise specified) to include various thicknesses of continuously cast metal, being thicknesses that could respectively be described as slab, or plate, or sheet, even relatively thin sheet.

In accordance with the invention, the belts as they travel through the casting region are cooled at their reverse faces, i.e. the surface of each opposite to that which engages the molten and solidifying metal, by guide-faced cooling nozzles and associated means constructed and arranged as described above. Such arrangements are provided for one or more desired predetermined areas of each or both of the belt paths, indeed advantageously for the entirety of each belt path along the mold space. The guiding faces of the nozzle elements very advantageously serve the function of guiding means for the belt paths, such that the belts can conform to desired path contour, whether precisely plane or very slightly curved or tapering toward the other path, or otherwise defining any selected surface configuration whatever which a belt can be caused to follow. The arrangement, as will now be understood, is preferably such that each belt, inherently or by special provision, is urged against the liquid layer and thus in effect against the collective guiding faces.

Thus the casting apparatus embraces the defined multiplicity of guide-faced nozzle elements, adjacent to the rear of each belt and arranged in surfaces respectively defining the belt paths. Through the centrally slightly concave, apertured faces, water as liquid coolant is projected perpendicularly against the reverse belt surface, whereby the high velocity layer of water is maintained. With such means, including the above-described enclosure means and associated means for supply and removal of liquid coolant, the moving belts are effectively cooled by the liquid layer of coolant, which separates the belts from, and as needed, supports them on the guiding elements.

It is especially advantageous to provide some subatmospheric pressure in each enclosure means, or otherwise to control the fluid pressures, whereby there is a substantially lower pressure on the reverse face of at least one belt, or preferably both, relative to the pressure in the mold space, i.e. independently of the effect of metal (or head of metal) there. The belts are thus forced positively toward the cooling and guiding elements, i.e. against the liquid layer, so that in effect each belt is positively held in conformity with its path as defined by the faces of the elements.

A further aspect of invention relative to systems of elements for guidance and support of the belts in a casting apparatus involves the provision of a multiplicity of path-defining or supporting elements, e.g. at least several rows and at least several or many in each row, over an area in the course of travel of the belt or other moving surface, with each such element resiliently mounted so as to yield indivually away from the belt or surface. Specifically, each element is arranged to be movable toward and away from the moving surface (i.e. toward and away from the mold space) and is loaded, e.g. by spring or other means, toward the belt or mold space. The preferred arrangement includes stop means limiting the movement toward the surface so that force exerted by the surface on the element (for instance through an intermediate liquid layer if desired) will not displace the element until it exceeds a predetermined threshold or limit value. Upon such event, the support or guide element is moved backward against the resilient loading, e.g. to accommodate any excessive force, e.g. locally exerted by the belt, as by reason of metal solidification or local variation of thickness thereof, or otherwise.

In belt casting apparatus wherein one or both of the belts is guided by a multiplicity of the new closely spaced guide-faced nozzle elements that provide the cooling and separating layer of liquid over the reverse face of the belt, an unusually advantageous structure involves the arrangement of the guiding and cooling elements each to have the above limit-loaded resilient mounting, including movability of the individual elements toward and away from the mold space, with the defined stop means interrupting such movement toward the space. Thus by resilience of the loading, against the springs or other means, each element is individually movable and yields to excessive force by the belt exerted through the liquid coolant layer.

These arrangements of limit-loaded support elements are specifically useful in permitting the casting belt to conform in good contact with the freezing or frozen surface of the metal while following a predetermined path. In a situation where the belt path or paths have a defined taper toward each other for accommodation of metal shrinkage upon solidification, optimum heat-removing or guided contact of belt with metal can be assured, for instance, by having a slight overtaper of the guiding path while relying on the yieldability of the guide elements (e.g. toward the end of the path) to allow the belts to fit the actual solidified thickness of the cast strip.

In their preferred form, the individual limit-loaded guiding elements are of unusual effectiveness for achieving maximum precision of guiding and maximum cooling action for the solidifying metal by keeping the cooled belt in complete contact with the metal even after its outer layers, indeed nearly all parts of it, have solidified in the outer parts of the mold space, yet permitting needed yieldability (to avoid jamming the equipment, or lesser adverse results), for the sake of minor irregularities in the thickness of the cast strip or even expected slight overthickness of the final or near-final strip. A superior casting is achieved, as to good surface without breakouts, and as to good interior structure, without undesired segregation or lack of homogeneity that has sometimes heretofore occurred with hard-to-cast alloys.

Another new and useful feature in belt casting apparatus according to the present invention is a novel bearing structure for carrying the endless belts along part of their return paths, especially in the portion of the path wherein each belt moves from an outer locality, remote from the mold space, back to traverse and define such space. Whereas in prior machines the belts have been so supported by rolls, or in some part by stationary curved surfaces, the present machine preferably includes a bearing which provides a liquid supporting layer, i.e. in basic accordance with the principles of liquid layer bearings that have been used for traveling bands or webs of flexible nature. Such thin, liquid layer, for spacing a band or strip from a conforming, curved support, is generally produced and maintained by directing liquid through apertures in the support, with means for withdrawing liquid peripherally from the layer, all controlled to keep the liquid layer in suitable continuity to carry the moving band.

In presently preferred embodiments of the new casting apparatus herein described, each belt is desired to traverse a curved surface as it approaches the mold space, advantageously making a 180° turn, as around half of a cylinder. For such purpose, the structure is basically constituted as a liquid layer bearing, including a curved support with apertures through it, preferably of a special nature as described below and also preferably with special cooling means in one area, whereby the moving belt is guided and supported on the flowing liquid along the curved path, essentially without friction.

As a further, special feature of the belt bearing, a portion of this curved path, approaching the mold space, is constituted by closely-spaced guide-faced cooling nozzles of basically the same sort as are embodied in the belt-cooling means along the mold space. Through this part of the moldapproaching belt path the underlying structure is thus made up of individual elements having suitably shaped guiding faces, with jet openings through which the liquid coolant is projected so as to provide a rapidly moving liquid layer spacing the belt from the collected nozzle faces while maintaining it in conformity with the desired path as defined by such faces. Effective cooling is thus afforded by the flow of coolant outwardly of each jet for withdrawal through small spaces between the guiding faces.

A special advantage of this liquid layer bearing (which can be called a hover bearing) to carry each belt around its necessary change of direction to the entrance or point of nip of the casting space is that in an optimum way it permits the superior cooling means, provided for the belt along that space, to be disposed fully throughout the space, beginning at the very entrance or even sooner. Where the belt, for example, is carried by a rotating pulley or roll, to accomplish a change of direction up to 180°, the downstream half of such roll presents an obstruction to the arrangement of effective cooling devices over a significant part of the path; they cannot be fitted, so to speak under the free half of the roll. Even though such a roll can have coolant grooves or the like in its surface, these are at best a compromise with the contact surface needed for bearing the tensioned belt; they have relatively small function in cooling the belt beneath the downstream part of the roll. The present liquid layer bearing requires no structure downstream of its actual curved surface that interferes with the highly effective cooling means designed for the run of the mold cavity; indeed in the preferred arrangement the special cooling means is brought not only to the nip point but also back around a considerable part of the curved bearing path. This latter feature is advantageous in various ways, at least in getting the belts actively cooled well ahead of the point of nip of the casting space so that they are less susceptible of thermal distortion.

As described below, a presently preferred arrangement of the apparatus involves supplying the molten metal, by suitable means, between the belts beginning at a locality in their curved bearing paths, i.e. upstream of their convergence to the casting entry where they become approximately parallel. The molten metal is thus, if desired, supplied in depth greater than the actual casting space between the belts, i.e. having greater dimension in a direction normal to the plane of its path through the mold space, and is thus in effect fed from a deep or large entering pool directly between and by the belts. With this arrangement, a more quiet feed of liquid metal is achieved, with the least possible turbulence and correspondingly better characteristics of the cast strip as it ultimately freezes in the mold space. The above-described, specially cooled nature of the belts at this preliminary region cooperates in this procedure and aids in the desired, over-all heat removal while minimizing thermal stresses in the belts.

The invention as embodied in continuous, belt casting apparatus has various advantages as explained above or as is apparent from the description below or as may be inherent in the described machine or its operation. For instance, a notably useful characteristic of the improved belt-stabilizing and cooling means is provided by structures so arranged that a desired configuration of belt path can be readily provided, at successive regions whereby slight taper of the belts toward each other, or a parallel relation, is attained as may be required for each region. In all of the foregoing and other ways, the invention achieves useful, new results, as will also be appreciated from the following further disclosure.

BRIEF DESCRIPTION OF THE DRAWINGS

FIGS. 4 and 5 are enlarged fragmentary sections of the belt-bearing structure in FIGS. 2 and 3, respectively on lines 4—4 and 5—5 of FIG. 3.

FIG. 6 is a greatly enlarged view similar to FIG. 5 but showing certain guiding and cooling elements in section.

FIG. 7 is an enlarged fragmentary section on line 7—7 of FIG. 3.

FIG. 8 is a fragmentary section on line 8—8 of FIG. 7, with the curvature of the bearing surface indicated. Because of reference to FIGS. 7 and 3, this view is seen as if inverted from a less detailed illustration of the same parts in FIG. 2.

FIG. 9 is an enlarged fragmentary section on line 9—9 of FIG. 3, shown as a section parallel to the section plane of FIG. 2 but displaced from it by a small distance.

FIG. 10 is an enlarged, axial, sectional view of a representative, guide-faced, cooling element used in the main mold-space section of the belt support assembly, showing the mounting of such element.

DETAILED DESCRIPTION

Figure 1:
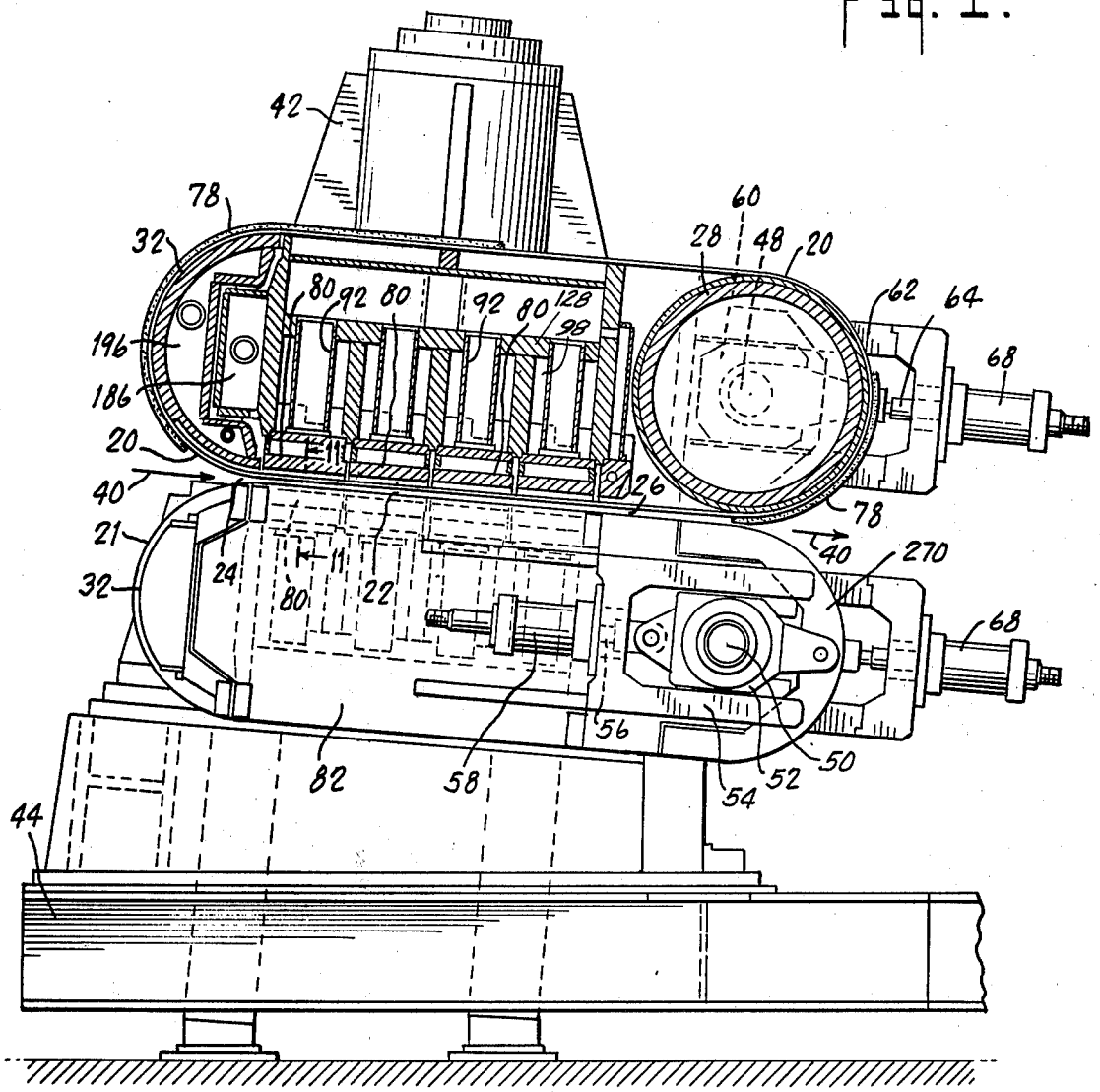
FIG. 1 is a general side view, chiefly in elevation but with a portion in vertical section, of a twin-belt casting apparatus embodying the feature of the present invention and thus constituting a representative example thereof. For comprehensively indicating most of the apparatus, this view is on a smaller scale than the further views, which also differ in scale among themselves as will be readily seen.

In the drawings, the various features of the invention are shown as embodied in a belt casting machine in which a pair of resiliently flexible heat conducting belts, e.g. metal belts, are endlessly drawn through a region where they are substantially parallel to each other, usually with desired convergence, so as to define a suitable mold space. Molten metal is continuously supplied into this mold space while the belts are cooled at their reverse surfaces, so that the metal solidifies and continuously emerges as cast strip. For clarity of illustration, various structural and mechanical details that do not directly pertain to the invention are omitted or shown only in simplified or schematic manner. Such parts and details include, for example, further details of the main supporting frame and of the frame structure within each belt loop, motor and gearing connections for the belt driving rolls, details of the systems for supply of cooling and other water, and various other auxiliary instrumentalities, all of which will be understood as needed but readily provided in conventional manner or otherwise by ordinary skill, in the light of the following description.

In the illustrated apparatus, the path of the metal being cast, although it may in other embodiments be more oblique or even vertical, is substantially horizontal with a small degree of downward slope from entrance to exit of the actual casting space. Thus the upper and lower endless belts 20 and 21 are arranged so that their faces are essentially parallel to each other (FIGS. 1 and 2) through the region where they define this casting space 22 from its entrance 24 to its exit 26. As will be appreciated, the belts are guided through suitable oval or otherwise looped return paths between their localities 26 and 24. In the present machine, the belt paths are essentially identical ovals, in symmetrically reversed relation above and below the zone 22. Thus the upper belt 20 passes around a cylindrical driving roll 28 and then travels along an upper path where it may be further supported, if desired, by rows of idler rollers 30 or the like, FIGS. 14 and 15. The ultimate return about a further semicylindrical path, for this upper belt 20, is achieved by a special liquid-layer, bearing arrangement generally designated 32 and particularly illustrated in FIGS. 2, 3, and other views. The lower belt 21 follows an essentially identical path including a drive roll 34 and a final, semicylindrical return bearing 32 similar to the bearing 32 above.

Figure 14:
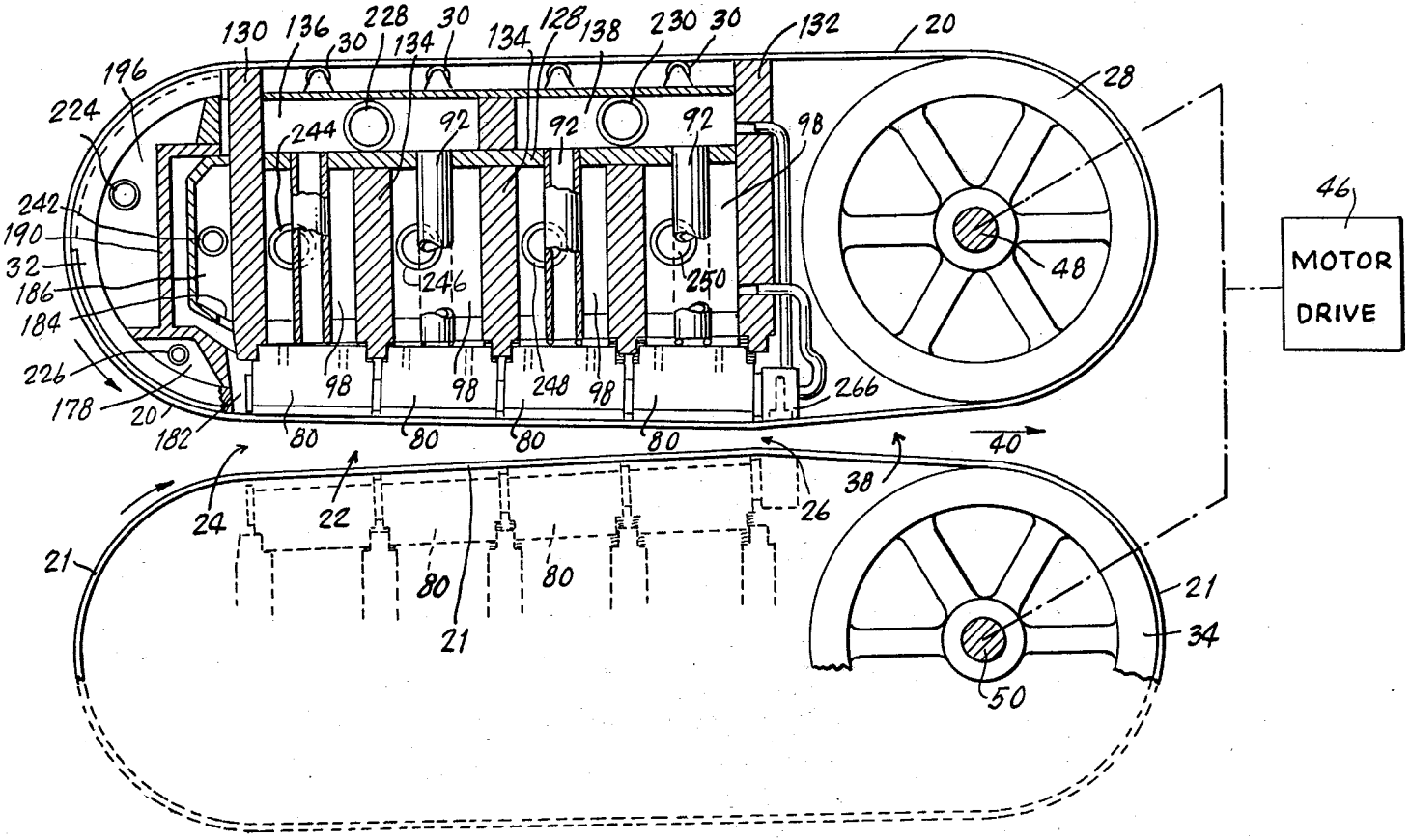
FIG. 14 is essentially a diagrammatic side view, greatly simplified, corresponding to portions of the view of FIG. 1 but with various structural details omitted, this view and FIG. 15 being designed to illustrate schematically the supply and withdrawal of cooling and belt-supporting liquid, and also the positioning of the several groups of guiding elements. Certain features and arrangements including the taper of belt paths have been very greatly exaggerated for purpose of illustration.

For handling convenience, and for avoiding damage due to overheating of the less efficiently cooled belts if in hard contact with the cast strip the solidification of which is intended to be finished by the time it reaches the exit locality 26, the belts 20, 21 may continue in somewhat parallel relation through a region 38 beyond the exit locality, with some slight divergence (if desired), all as indicated in FIG. 14. The path of metal is so indicated by the arrows 40 in the several views. The belts themselves are constructed in appropriate manner for casting apparatus of this type, being advantageously of metal, for example, suitably flexible but stiffly resilient steel of appropriately high strength and of such nature that it can be sufficiently tensioned without inelastic yield.

The apparatus, and particularly the belt-carrying structures, can be supported from or in any desired type of framework such as generally indicated by the upright structure 42 and lower or base structure 44 in FIG. 1, all arranged, as will be understood, to hold the belt-holding frameworks in adjustable, pre-set spacing and with appropriate provision (not shown) to permit moving the frameworks apart, for insertion and removal of the belts or for other adjustments and servicing as necessary. The belts may or may not be faced with special surface treatment, e.g. a thermal insulating coating facing the mold space, as has heretofore often been employed in belt casting apparatus. In the present machine, the superior water cooling arrangement is such that there may be only low temperature drops at the water/belt interface and through the thickness of the belt; i.e. the belt is kept at an unusually low temperature at its surface next to the metal, so that efficient heat removal is achieved, and the usual belt coating may need less insulating function to avoid high temperature gradients and corresponding belt-buckling thermal stresses, internally of the belt.

The belts 20, 21 are respectively driven by the rolls 28, 34, as schematically indicated in FIG. 14, with a motor drive 46 having appropriate connections to the shafts 48, 50 of the drive rolls, including suitable gearing and other necessary drive coupling (not shown) as will be readily understood. Although other tensioning means may be employed, the apparatus as shown (FIGS. 1 and 15) includes fluid cylinder means for positionally adjusting the shafts 48, 50 and holding them with appropriate tension on the respective belts. As seen in FIG. 1, one end of each of the shafts (e.g., shown for shaft 50) is carried by a journal bearing 52 arranged to be horizontally displaced either way in the direction of the length of the mold space 22, in a sliding support 54 and to be so positioned by a piston 56 in a double-acting hydraulic cylinder 58. The other end of the roll shaft, e.g. as indicated at the shaft 48 of the roll 28 (FIGS. 1 and 15), has a similar journal bearing structure 60 sliding in a support 62 and connected to a piston 64 of a similar double-acting hydraulic cylinder 68.

Although not all of these elements are actually here shown for both rolls, it will be understood that the shafts 48 and 50 of the two driving rolls are thus each supported at their ends by journal bearings as described, each pair of journal bearings for each roll having respective positioning cylinders 58 and 68 so that by appropriate adjustment of the cylinders the drive roll can be located to hold the associated belt in suitable tension for belt-driving operation and other proper functioning of the belt as described below, such adjustment including, if desired, the attainment of a desired exact alignment of the roll axis if required by slight angular movement of the axis in a horizontal plane. It will be understood that although the cylinders 58 and 68 are shown for structural convenience as extending in opposite directions at opposite sides of the assembly, their function is the same as if they both extended in the same direction for each roll.

Figure 2:
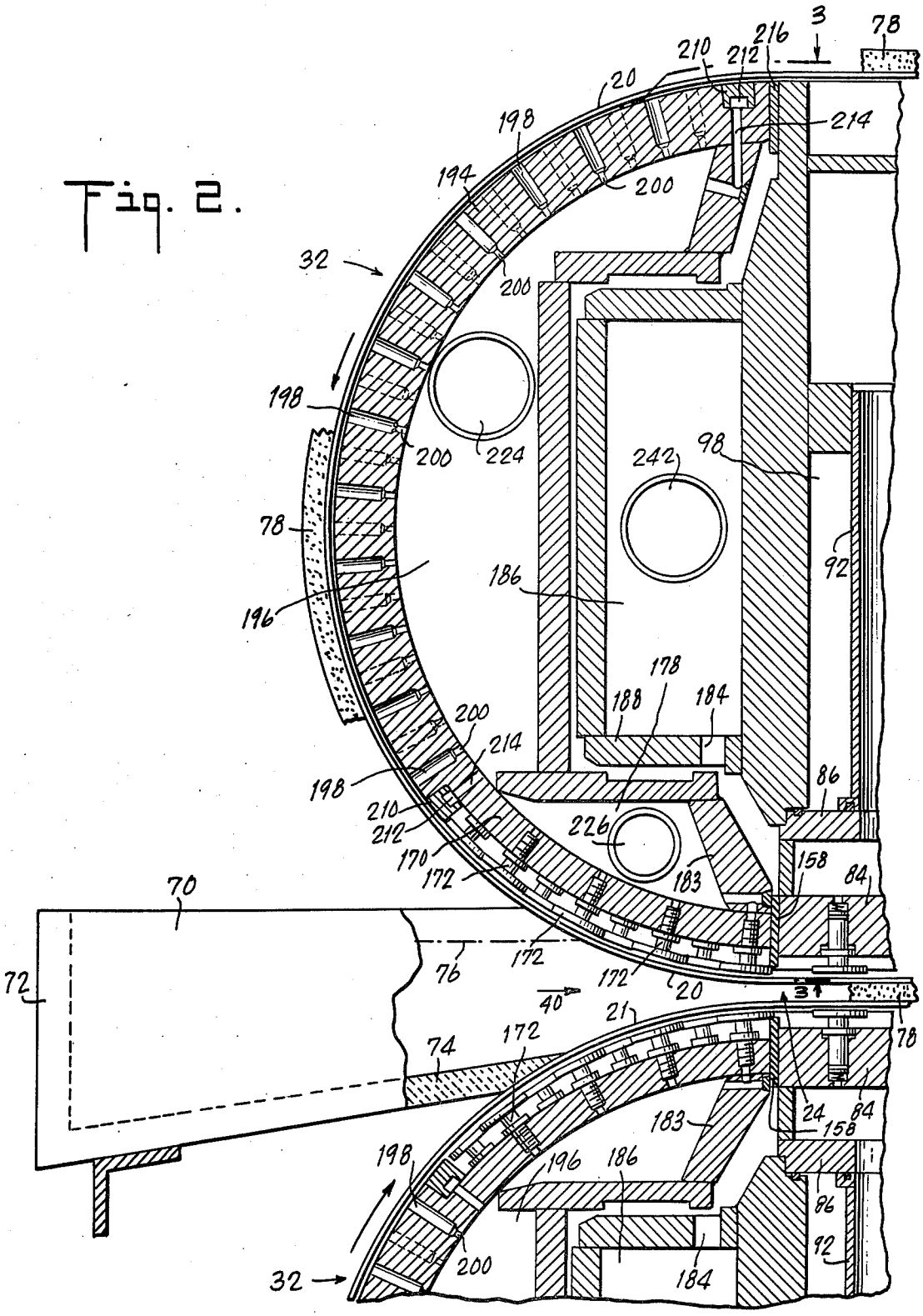
FIG. 2 is an enlarged vertical secton of a part of the apparatus of FIG. 1 at the left-hand end, showing details and further elements that were omitted from FIG. 1 for simplicity.
Figure 15:
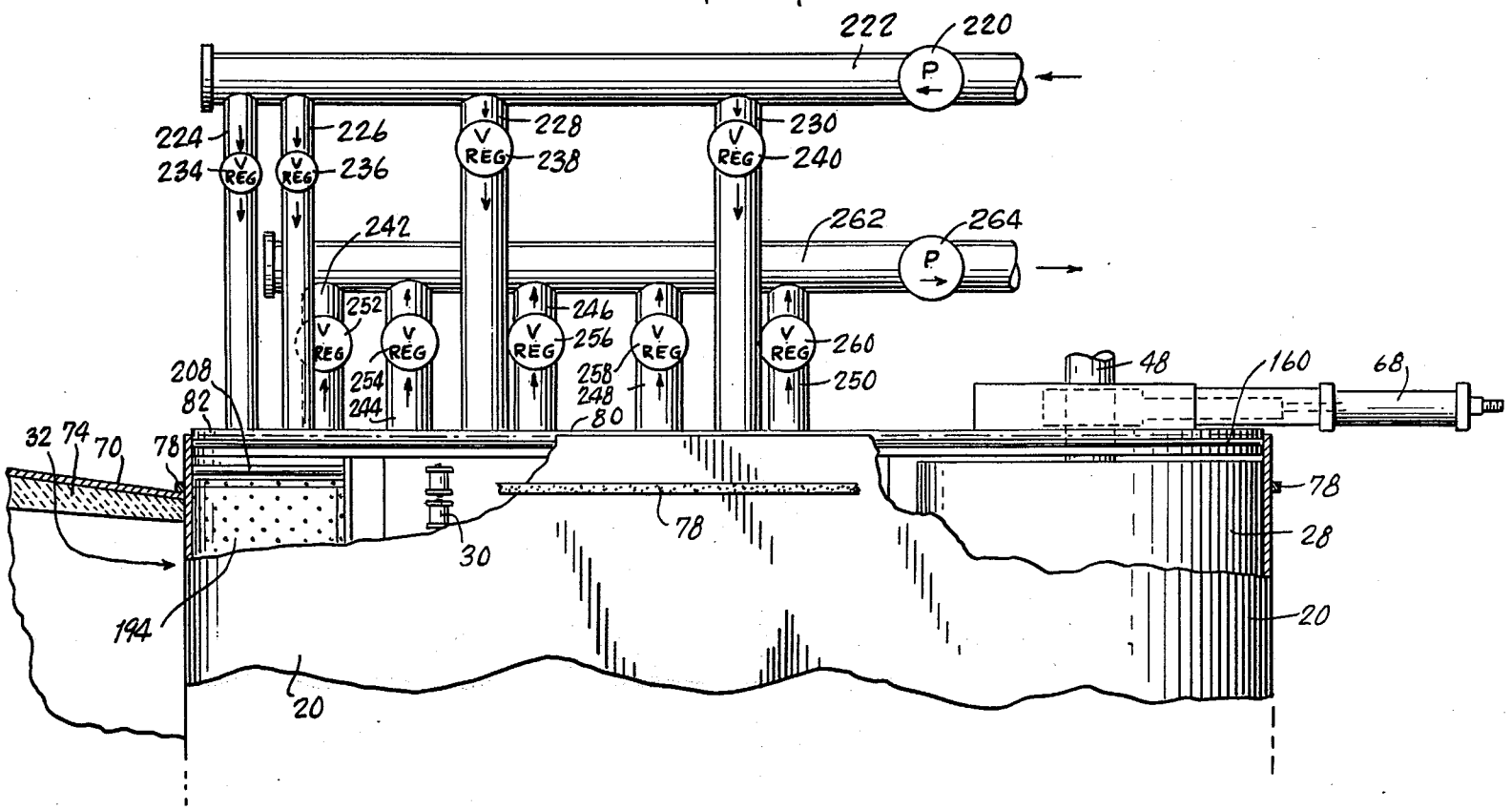
FIG. 15 is a similar, simplified, largely diagrammatic view, chiefly in top plan but with some parts in section, of the apparatus as shown in FIG. 14.

Molten metal is supplied to the casting zone 22 by a suitable launder or trough 70 which is disposed at the lefthand end of the apparatus as seen in FIGS. 2 and 15, and which may have a structure that is generally of appropriate, known sort, including a suitable front port in the wall 72 whereby liquid metal is continuously supplied, with a suitable duct from a furnace or the like (not shown). The launder 70 is lined as at 74 with refractory material. Although in general the prior practice has been to supply the metal more or less directly to the entrance 24 of the parallel portion of the belt paths and in a depth about equal to the belt spacing, and although such practice may if desired be followed with the presently improved machine, it is here contemplated that the launder 70 have a vertically much taller body so that the supplied molten metal, e.g. up to a level 76, forms in effect a deep pool, coming in contact with the belts 20, 21 at localities well ahead of the mold entrance 24. Thus for instance, the metal meets the mutually converging belts as illustrated in FIG. 2, or may even meet the belts at places further back from the entrance 24, along special regions of the curved belt-bearing supports 32, 32 as described below.

One useful construction involves bringing the liquid metal to a significantly greater depth on the upper belt, i.e. up along the upper bearing 32, well ahead of the point of nip or entrance 24 of the casting space, while getting the metal into contact with the lower belt at little or no distance (over the lower bearing 32) upstream of the nip point 24. With this or other arrangements for providing a deep supply pool of metal, there is special advantage in having such a pool which serves to keep the metal quiet and to eliminate turbulence as it gets into the actual mold space 22. There are in consequence fewer surface irregularities and fewer internal defects in the cast strip, i.e. smoother, better surfaces and better homogeneity of microstructure. The special cooling (described below) of the curved portions of the bearing supports 32 and 32 nearest the mold entrance 24 cooperates in avoiding undue thermal shock or stress in the belts.

As is usual in belt casting machines, the apparatus is provided with edge dams, necessarily at least one at each side, so as to complete the enclosure of the mold cavity 22 at its edges. Thus, as indicated in FIGS. 1–5, 11, 12 and 15, a pair of edge dams 78 of rectangular cross section are shown moving with the upper belt 20, being carried at the exposed surface of the belt near its respective side edges. Although other edge dam constructions, preferably of flexible or articulated arrangement and moving with one or both of the belts, can be employed, a suitable dam 78 may be a compressible, heat-resistant strip consisting of a metal wire or other core surrounded by woven or like layers of asbestos or other refractory fibers. Each dam 78 can be temporarily adhered to one of the belts, e.g. the upper belt 20, as an endless strip coextensive with the belt. Whether so retained or otherwise guided, the dams are held in suitable longitudinal positions so that when they are compressively engaged between the belts they close the cavity edgewise at the desired transverse dimension and thus keep the molten metal precisely in the path where it is fully cooled through the belts as described below. In this way the dams 78 define the width of the cast strip. The dams can be designed, as by their described compressibility, to accommodate small differences in the spacing of the upper and lower belts 20, 21, as occurs for example along a slight converging taper from entrance to exit of the mold space.

The new system for cooling the belts (along the casting zone 22), which most advantageously also serves to stabilize the belts in their desired paths, is illustrated in FIGS. 1, 2, and 10–14, inclusive, and is conveniently divided into a succession of unit assemblies 80, which may be called cooling pads along the course of each belt. Although other cooling arrangements, or modifications of the new cooling devices, can be employed at one or another of the succeeding localities for either or both belts, the several cooling pad assemblies 80 are here shown as identical in structure at all places for both belts 20 and 21. Each pad 80 comprises a boxlike support which may extend entirely across the path of the adjacent belt and can be fitted between heavy side frame plates such as member 82 in FIG. 11, there being one such member at each side of the upper and lower belt carriages. The enclosing structure of the pad 80 may have a horizontal platelike member 84 nearest the belt path, another plate 86 spaced from and parallel to the member 84, and a square frame 88 completing the box and forming side walls for the space 90 between the plates 84 and 86.

This space 90 is designed to receive a supply of water, as liquid coolant, through one or more large pipes 92 each fitted to a corresponding opening 94 in the plate 86. The region outside of the plate 86, i.e. remote from the belt 21, communicates for liquid flow through passages 96 that extend through the box to such region from the space outside of the plate 84 that is closest to the casting belt. Such passages 96 through the box (traversing the plates 84 and 86) thus serve to carry the discharge of cooling water from the side of the pad 80 adjacent to the belt, to the region 98 on the other side from the belt, where such water is collected for removal. The passages 96 are constituted by sleeves 100 where they traverse the space 90. There are preferably many of these passages 96 distributed laterally throughout the pad, but so disposed as not to coincide with the opening or openings 94 or with further smaller openings (described below) in the plate 84 through which the high-pressure liquid is directed.

The cooling and support of the belt is accomplished by a large multiplicity of guide-faced cooling elements 102 (FIGS. 10 to 13) distributed throughout the belt-adjacent plate 84 of the pad 80 so as to present a substantially continuous and substantially level surface which can precisely define the contour desired for the belt path, and next to which, with a small liquid-layer spacing, the belt is therefore designed to travel. Each of these elements 102 comprises a wide portion or head 104 that provides a circular belt-facing surface 106, and a shank portion 108 of cylindrical, tubular configuration seated with axially sliding fit in a corresponding recess 110 of the supporting plate 84. The hollow interior 112 of the guide element shank 108 is fairly wide throughout most of its length but closes to a narrow jet aperture 114 through the center of the face 106, which in turn has a centrally, very slightly concave shape as indicated with some exaggeration of its depth in FIG. 10, the shape being a very shallow cone surrounded, if desired, by a narrow annular land, i.e. plane area. Although these elements, particularly as to their belt-guiding faces 106, may have other peripheral shapes (e.g. rectangular, triangular, elliptical or otherwise polygonal or curved in plan) and other than the shallow, conical concavity shown (e.g. a very shallow recess of coaxially cylindrical or spherical shape), the illustrated configuration of the circular face and the depression and jet opening are believed to be especially advantageous.

The interior of each recess 110 in the plate 84 opens through a short passage 116 to the space 90 between the plates 84 and 86 of the cooling pad, which opens into the related supply pipe or pipes 92, whereby high-pressure liquid coolant, e.g. water, is directed into each of the elements 102 and caused to jet against the belt through the nozzle opening 114. The shank 108 of the cooling element is sealed within its recess 110 by a suitable annular seal 118 (such as an O-ring, if desired) in a circumferential groove in the shank, i.e. a rubber sealing ring to keep water from communicating between the spaces on opposite sides of the plate 84, but nevertheless such as to allow relative vertical sliding of the parts.

Advantageously, the element 102 is biased or loaded toward the belt, i.e. toward the casting space, by appropriate means, preferably having some compressible or yieldable character, such as fluid or spring means or other instrumentality of like function, or advantageously a combination of such means. Thus in the construction shown, the fluid pressure of the confined flow of water supplied to the element applies considerable loading force, beyond that required or consumed for directing the jet through the opening 114, e.g. by the pressure exerted on the lower end (FIG. 10) of the hollow shank 108 of the element and on the step 113 between the interior passage 112 and the jet opening 114. The loading is supplemented by special resilient means such as a compressed coil spring 120 between the bottom of the recess 110 (which is wider than the opening 116 through it) and the lower end of the element shank 108. In a presently contemplated mode of operation of the apparatus, the major part of the loading (i.e. the initial or base loading of the element) is effected by the force of the water (whereby the element yields only when the belt exerts a greater opposing force), with significant, resilient contribution by the elastic force of the spring 120, especially in governing the extent to which the force of the belt may displace the element 102.

For further guiding and restraining the element 102, it carries an annular flange 122 which seats, conveniently with a sliding fit, in a cylindrical recess 124, i.e. a coaxial enlargement of the recess 110, in the face of the plate 84 that is adjacent to the belt. Removable stop means are provided to engage the outer face of this flange 122, e.g. as indicated by the stop 126 in FIG. 10. For example, each of the stop elements 126 may be a disk disposed to overlap the flanges 126 of a group of nozzle elements 102, say three, each disk 126 being removably bolted on the plate 84.

Thus each element 102 is urged or pre-loaded against a stop 126 by the spring 120, and in operation also (and usually predominantly) by the force of the water flowing at high pressure, but if the pressure or force of the belt, for example exerted through the liquid layer upon the face 106 of the element, is sufficient to exceed the total limit loading on the element, the entire element can be pushed rearwardly against the spring 120. By this action, the spring is compressed, allowing the element 102 to yield to accommodate the excess force on the belt and permit the belt to move correspondingly outward of the mold space.

It is conceived that useful loading on a belt guiding or supporting element, such as the element 102, can be achieved by water pressure alone or spring force alone or by other suitable means of yieldable character (whether or not resilient, although preferably so), and indeed that in some cases, as with other provision for releasably holding the element in an initial position, or as in some parts of the belt path relative to the state of the solidifying metal, there need be no positive stop. The feature of providing bias on the element generally requires that there be means which serves a loading function by exerting an opposing force responsive to incipient displacement (or to tendency to displacement) of the element when the belt, for instance because of solidified metal against it, in effect pushes against the element. Special advantage, however, resides in the provision of pre-load, whether partly or wholly of elastic nature, against a stop, and the arrangement shown is presently preferred, where the water pressure is available to afford a substantial part of the pre-load, plus some preload due to the spring or the like, which upon actual compression then exerts an increasing and thus progressively greater opposing force upon displacement. The spring, of course, also serves to hold the element in desired place at non-operating times, when no water is supplied.

The cooling and supporting functions of the elements 102 advantageously involves the projection of the high-pressure jets of water through the central openings 114 against the reverse surface of the adjacent belt 20 or 21 so that the jet is turned into a radially flowing, preferably thin layer of water confined between the element face 106 and the reverse belt surface. This flow between and along the element and belt surfaces is very rapid, i.e. of high velocity, affording excellent heat removal from the metal belt. At the same time, the pressure and quantity of flow of the water is advantageously controlled, in a manner which will now be readily understood, so that by the compressed, thin layer of water the belt is maintained in separation from the actual face 106 of the guiding and cooling elements, in a firm hovering relation, yet the belt can be forced toward the face, as by suction (such as may be produced by a desired subatmospheric pressure in the liquid layer) or by pressure of solidified metal, whereby the belt is stabilized in position. Hence, although the belt does not actually touch the element face, it can be considered as in effect held against it, i.e. through the intervening liquid layer.

In other words, the arrangement provides a liquid bearing for the belt, and a novel, highly efficient heat-removing action by virtue of the many individual jets, the rapid radial flows and the coacting immediate removal of water between the moving nozzle faces 106. Very preferably, such removal is effected at the periphery of each face, for example primarily through the triangular spaces between each three adjoining elements as shown (FIG. 12); in this or other suitable arrangement, water projected from one face does not have to flow across any other face.

Figure 11:
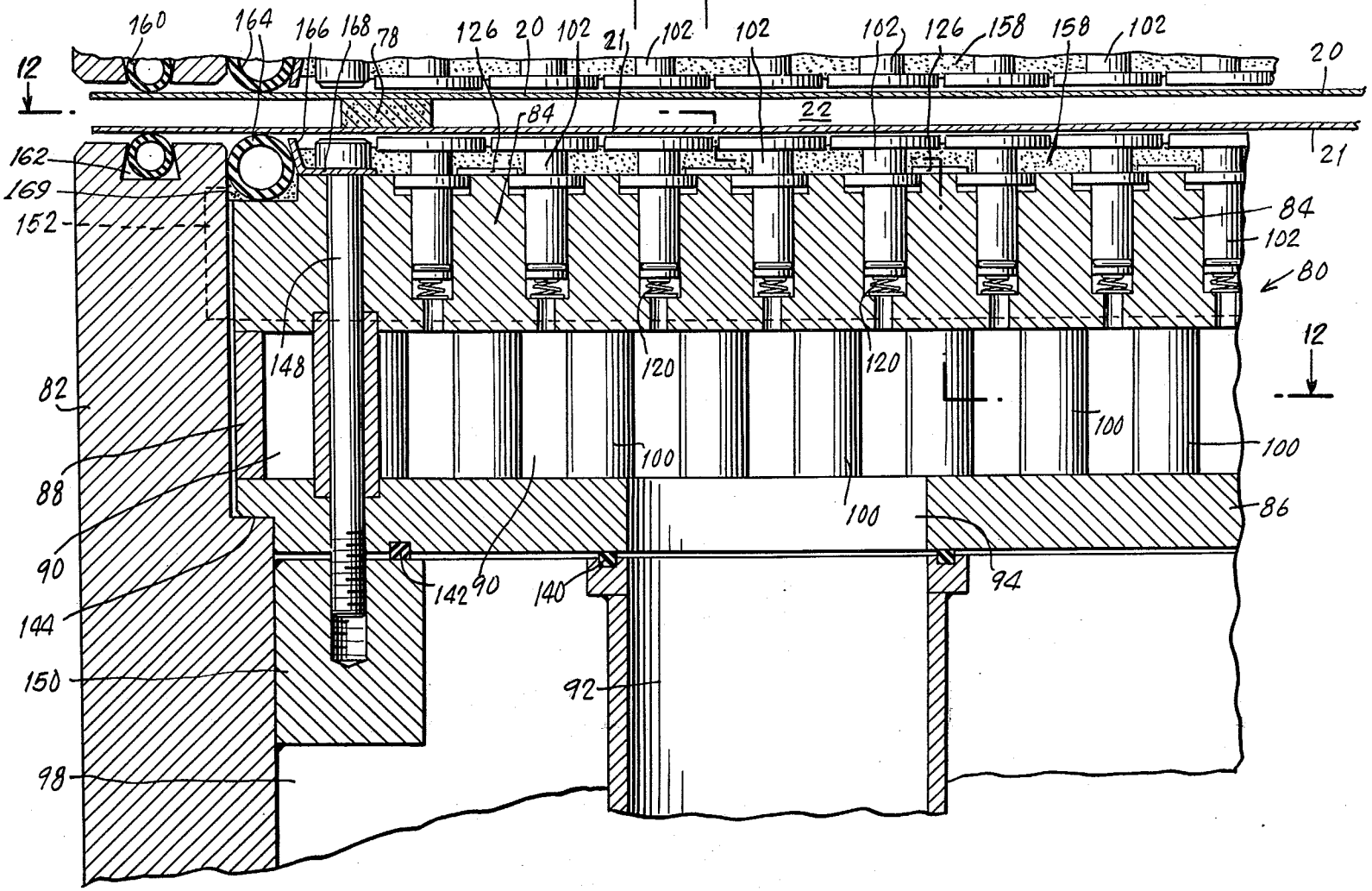
FIG. 11 is a fragmentary, transverse, vertical section, extending across part of the path of the belts, as on line 11—11 of FIG. 1 (and FIG. 12).

The water from the space above the plate 84 of each cooling pad assembly, being particularly the water coming into the space under the element heads 104, is drawn through the passages 96 into the space 98 which is itself enclosed by further frame structure of the belt carriage assembly. For example, each such space 98 is enclosed by part of a horizontal plate 128 (FIGS. 1 and 14), common to all these spaces, and by vertical plates transversely disposed across the belt carriage frame, being end plates 130, 132 and intermediate plates 134. At the sides, these outlet chambers 98 can be enclosed by the main side frame plates 82, e.g. as seen in FIG. 11. The pipes 92, which carry the high-pressure water to the jet nozzles, traverse the chambers 98 and open into a chamber or chambers at the opposite side of the plate 128. For convenience, a pair of these high-pressure water supply chambers are shown at 136, 138 in FIG. 14, each supplying two mutually adjoining pads, although it will be understood that the separate pads 80 can be supplied individually, or from a single chamber or plenum. All of this depends chiefly on the extent of need for separate pressure or volume control of the supplied liquid coolant.

Advantageously the liquid supply and withdrawal system is so controlled that not only all the inlet chambers 136, 138 and 90 but particularly each chamber 98, as well as the entire space between the box of each pad 80 and the casting belt 20 or 21, can be kept at preset pressures. The arrangement is such that there is continuous contact of substantially the entire rear face of each belt with fast-moving water, and also permits effective control of the pressure at the reverse face of the belt, as for example in maintaining a subatmospheric pressure whereby a substantial pressure difference across the belt (independent of metal head or metal solidification) creates a force that pulls the belt toward the guiding element faces and in effect holds the belt against the faces through the intervening layer of water, thereby stabilizing the belt in its desired path.

It is not deemed necessary that these chambers and spaces be kept full of water, especially to the extent that air may leak in through the seals (described below), and may accumulate, notably in the drain chambers and spaces (especially in the lower belt carriage), for removal by pressure control valving and vacuum pumping means (not shown) which can extend from the chambers separately from the drain piping for water through suitable means (which may include barometric legs or the like) schematically shown in FIG. 15. As will be understood, the chambers and conduits for inlet water under pressure in both carriages are necessarily filled for continuous supply through the jet apertures 114 and corresponding maintenance of the complete layer of local high velocity water flows adjacent to the belts.

For optimum realization of the effect of the individual elements in cooling and guiding each belt, and also the cooperating effect of the preferred, individually limit-loaded arrangement of the support elements (a feature highly useful even in circumstances where the liquid layer bearing concept is not employed), there are a large multiplicity of these guide elements distributed in close spacing throughout the area of the belt path for which such guide and support is desired. In general, the invention contemplates at least several transverse rows of such elements, with at least several individual elements in each row across the path of the belt. Indeed, for casting apparatus having provision for casting strip even in widths as small as one foot (30 cm.) or so, it is believed that there should advantageously be for instance at least four or five individual elements in each row and at least five such rows (in the direction of belt travel), in order to obtain the individualized support effects throughout even a limited desired area. More specifically, in one practical example of the apparatus, these elements can have a face diameter of about 1.5 inches (3.5 to 4 cm.) and can be distributed across the belt path in nearly touching relation (and disposed in staggered relation in succeeding rows, whereby each element head 104 is close to two in each adjacent row); in such circumstances, to cool and support a belt for a casting width of, say, 30 to 40 inches (75 to 100 cm.), there can be as many as about 20 elements or more in each crosswise row.

It is presently believed that circular-faced elements 102 as shown are particularly desirable, arranged in a repeated hexagonal, i.e. staggered, pattern as apparent in the drawings, whereby small triangular-shaped openings are created in the otherwise essentially complete surface constituted by the element faces 104. As explained above, the water flow from the faces returns directly through these openings to the region which lies between the element heads and the outside of the plate 84 and from which the water passes into the space 98. Thus a significant, preferred feature is that the arrangement of slightly concave jet-directing faces (whether constituted as individual elements or integrated as many such faces in a single surface structure) have at least small openings between all of them whereby the liquid flowing across each defined face, radially from the jet, is directly withdrawn.

The pads 80 are fitted to the conduits 92 by rubber sealing rings 140 at the outer surfaces of the plates 86 (FIGS. 11, 13), while each pad is sealed to the adjacent face of the structure that constitutes the water outlet chamber 98 by similar sealing strips 142 extending entirely around and near the edge of the outer face of the plate 86. The pads can be adjusted in position toward and away from the belts, by inserting shims at localities indicated at 144 and 145, while the natural compressibility and elasticity of the rubber sealing elements 140, 142 keeps the chambers 90 and 98 closed by the plate 86 in all cases.

As shown in FIG. 11, the pads can be secured in place by long bolts 148 extending from the belt-adjacent face of the plate 34 through the plate 86 to appropriate projections or abutments 150 of the side plates 82 of the belt carriage assembly. By such or other means at each side of the carriage, each cooling pad 80 is removably secured in place, while its position toward or away from the casting space, parallel or at any slight angle to the central plane of the latter, can be precisely determined (and the desired belt path can be correspondingly determined) by the inclusion of a suitable number of shims, or no shim, at the above-described shoulders or steps 144, 145, lengthwise and transversely of the structure against which the pad seats.

Figure 12:
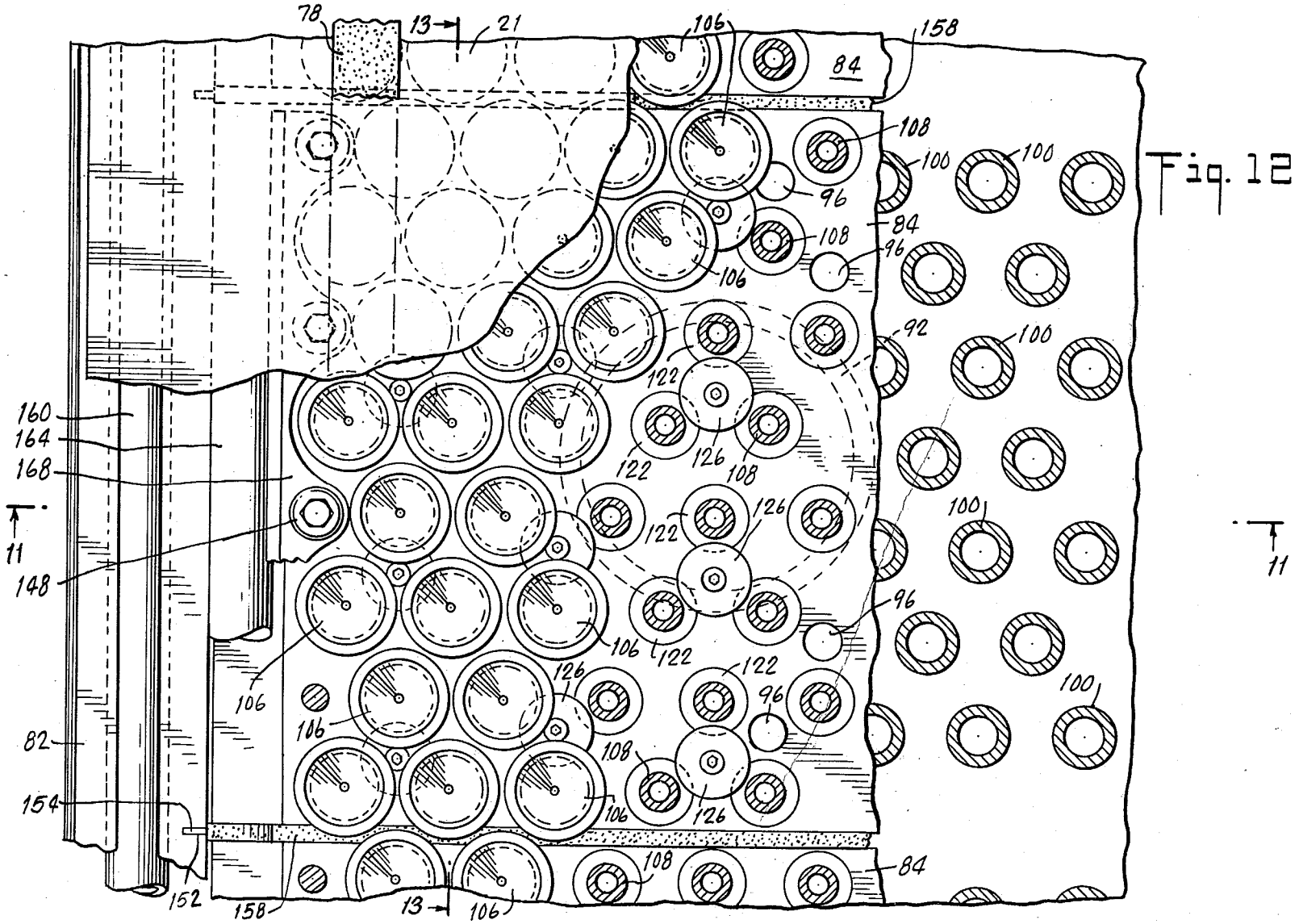
FIG. 12 is a fragmentary, generally horizontal view taken in parts respectively on different parallel planes as indicated by the line 12—12 of FIG. 11.
Figure 13:
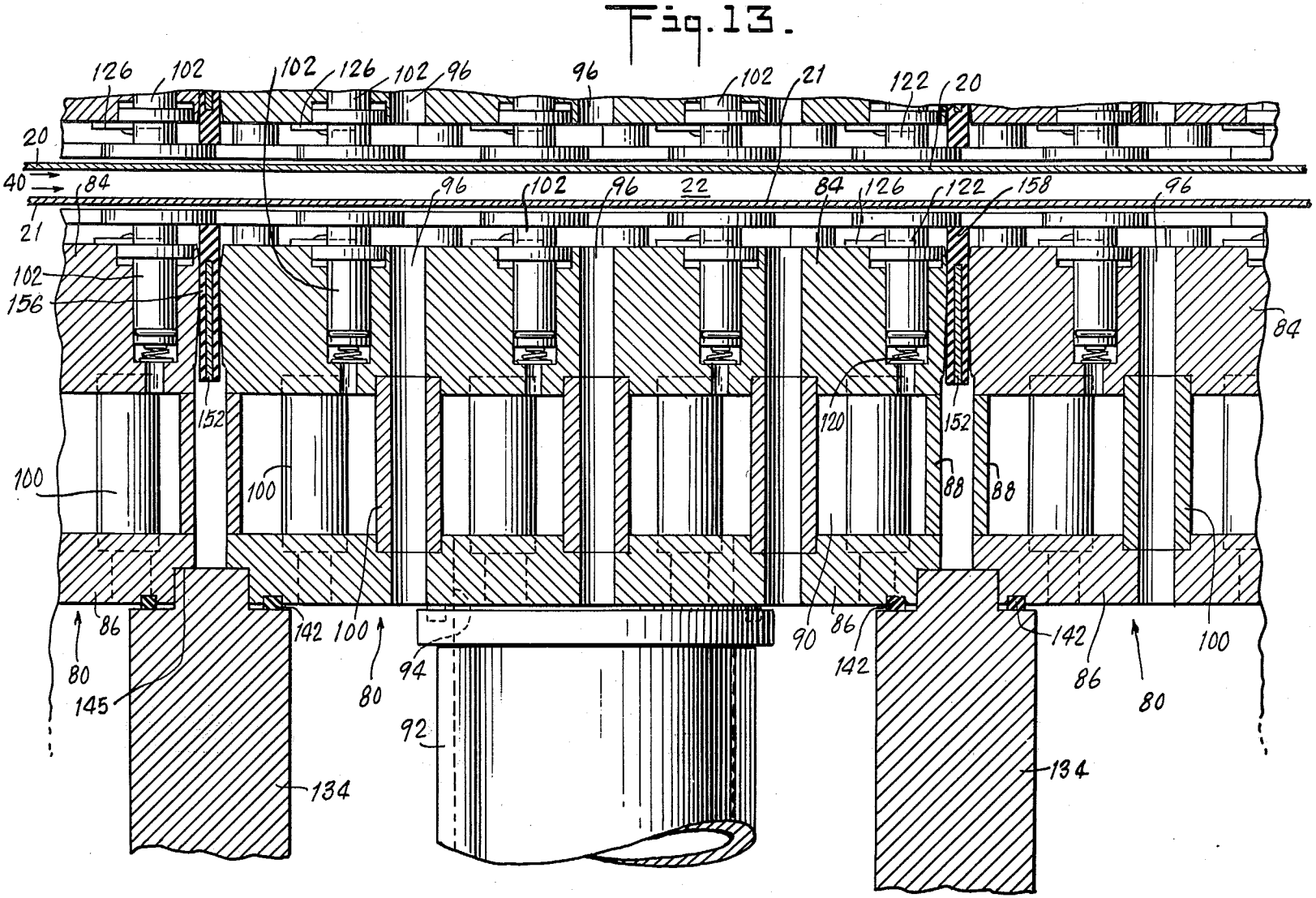
FIG. 13 is a fragmentary vertical section on line 13—13 of FIG. 12.

Especially to facilitate individual control of the pressures maintained at the reverse belt surface by the liquid coolant of the individual pads, and also to maintain proper integrity of the liquid supply and withdrawal systems, there are transverse seals between the pads and at the ends of the set of pads. A suitable arrangement, for example, comprises an upright metal strip or thin plate 152 (FIGS. 11–13) extending across the machine, transversely of the belt path and between slots 154 (in which the ends of this strip are received) in the side plates 82. Each of these rigid strips is coated or encased with rubber 156 and carries an upper fin 158 likewise of rubber along its length except near slots 154. This resilient or elastic structure thus in effect constitutes a partition entirely across the belt carriage between successive cooling pads 80 and at the initial and final transverse boundaries of the first and last pads. The upright rubber portions 158 of these members conveniently bear against the under surfaces of the heads 104 of the guide elements 102 immediately adjacent this sealing partition, as shown in FIGS. 12 and 13. That is to say, the guide element heads of the respectively adjacent pads project alternately over the sealing strip, in the partial interlocking configuration that characterizes all the adjacent staggered pairs of rows. In this manner the sealing strip constitutes an effective seal along the cooling elements 102 all the way across the belt carriage, except for the narrow space occupied by the cooling layer of water wherein the pattern of flows in effect precludes the need for a seal.

For side seal and guidance of the belts, the frame members 82 carry a large compressible sealing ring 160, e.g. a hollow rubber tube or the like, completely around each belt carriage on the horizontal edges of the plate structure 82 at each side, this sealing and supporting member 160 being held in a groove 162. Further side seal can be provided at the localities of the cooling pads, e.g. inward of the outer seal ring 160 toward the casting space, for best retaining the water in the cooling regions and preventing either escape of water or inlet of air. For example, as seen in FIGS. 11 and 12, an elongated tubular rubber sealing element 164, advantageously larger than the element 160, is carried between the inner face of the side plate 82 and a metal strip 166 which in effect is constituted as an upright flange, sloped slightly over the rubber element 164, of a length of metal angle 168 that has suitable holes through which it is held by the bolts 148. The sealing element 164 is thus held in the groove formed by the flange 166, plate 82, and a horizontal step 169 of the pad plate 84, one such element extending along each side of the pads 80, passing cut-out regions of the seals 158. As will be understood, other longitudinal seals can be used, e.g. of rectangular section, with a low-friction face backed by foam rubber.

The end bearing structures, 32, whereby each associated belt approaches the casting cavity around a semicylindrical or other curve, preferably carry each belt on a liquid layer bearing. Advantageously a lower portion of this structure for the upper carriage, and the upper portion of the structure for the lower carriage, can be arranged to provide the same cooling operation as the elements 102 in the cooling pads along the mold cavity 22. Thus the bearing structure 32 includes a curved plate portion 170 (this being specifically described for the upper one of the structures, with which the one below is identical) that extends from the locality 24 where the path of the belt departs into the mold cavity on a tangent plane, rearwardly up the curve for a considerable distance, e.g. angularly defined as more than 10° and advantageously a distance in the range of 30° to approximately 45° as shown. Throughout this part of the belt path (see FIGS. 2, 3, 5, 6, and 9), the underlying surface is constituted by a large multiplicity of guide-faced cooling elements 172 arranged with their faces in partially interlocking rows exactly like the rows of elements 102, and each likewise having a slightly concave circular face 173 (preferably a shallow central zone) in its head 174, with a central jet aperture 176 through which liquid is directed at high pressure from the underlying chamber 178.

Figure 3:
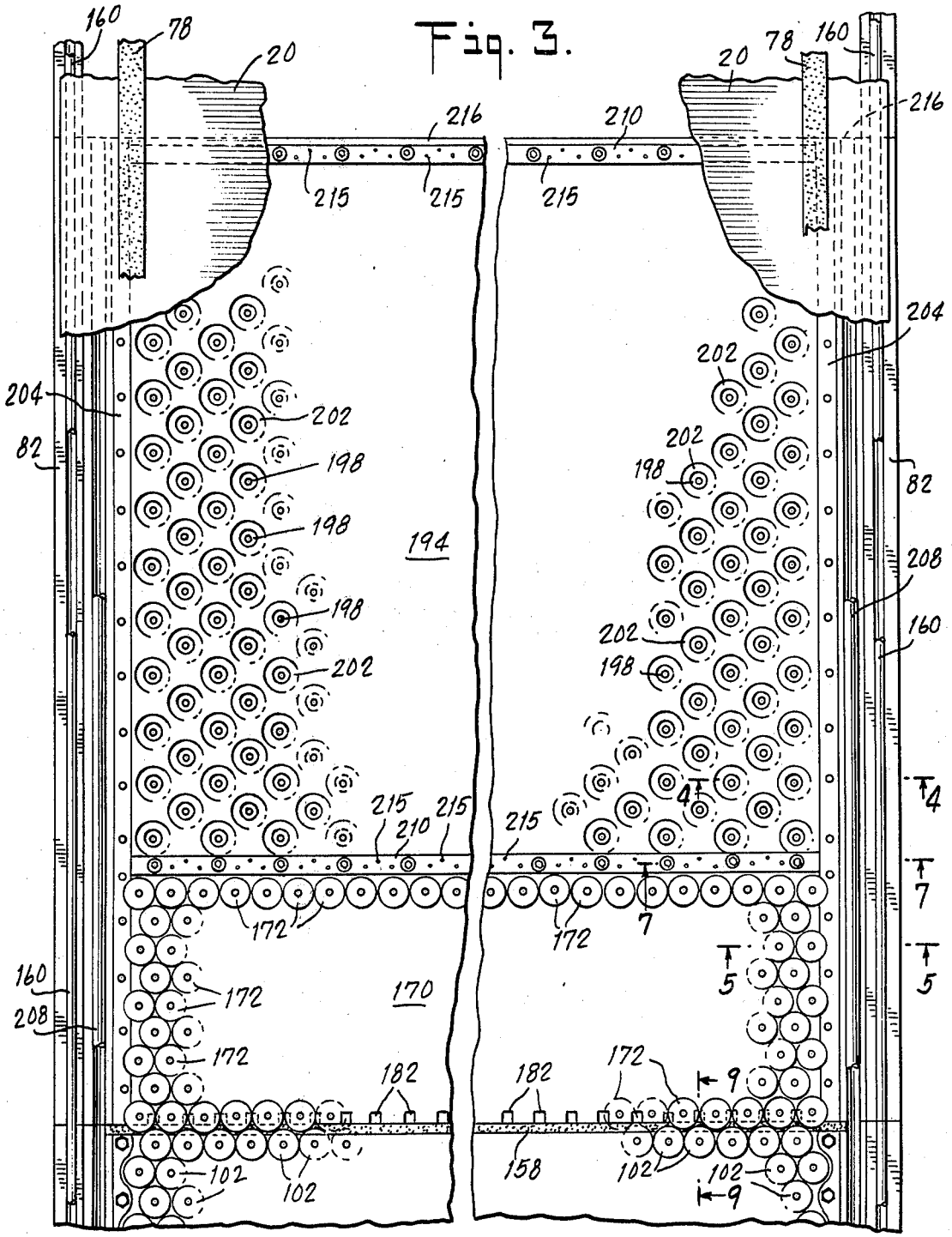
FIG. 3 is in effect an external view of the semicylindrical curved structure around which the upper belt passes in FIG. 2, such structure being shown in FIG. 3 as if developed into a plane surface, and thus as if seen on the curved line 3—3 of FIG. 2. This view also includes an entering portion of the essentially plane path of the belt at the casting mold space.

Hence the entire underlying support for each belt, through this region, is constituted in effect by means similar to the cooling pads, whereby the highly efficient, rapidly flowing liquid layer, i.e. flowing in a radially outward direction from each of the individual jets, is produced, and the belt is supported and guided or stabilized by these nozzle faces 173, with an intervening bearing layer of liquid. This liquid, e.g. water, then passing down into the space below the heads 174 of the elements, is withdrawn in any suitable manner, as through slots 180 across the assembly in that edge of the plate 170 which adjoins the transverse sealing element 158 at the entering boundary of the first cooling pad 80. The arrangement of these slots is seen in FIGS. 2, 3, and 9, being disposed beneath the guide element heads 174 that at their outer parts overlap the seal 158, which also seals the sides of the slots. The slots thus open to the space under all the element heads 174 and register with slot passages 182 (in a frame wall 183), that extend through coacting passage structure 184 into an outlet chamber 186 contained in a head portion 188 of the main carriage frame that is surrounded by an offset cross-wall assembly 190 of the bearing structure 32.

By this arrangement, each of the curved bearing supports 32 includes a portion where the belts are guided and cooled with high efficiency by apertured guide faces of the same basic nature as in the cooling pads. Inasmuch as the need for special yieldability ordinarily does not exist in this region of the belt path, the elements can be rigidly mounted in the plate 170, as by being threaded therein, although a resilient mounting (as preferred in the cooling pads) can be employed if desired. Water under pressure is supplied to the chamber 178, from which it flows through the axial recesses 192 in the elements 172, to provide the jets through the openings 176 against the reverse surface of the belt. Although such configuration cannot be shown in the scale of the drawings, the faces 173 of the heads 174 of the elements 172 are preferably ground to a cylindrical curvature, i.e. the curvature of the complete bearing structure 32, for collectively defining, in effect, the curved path which the belt is to follow over the intervening, thin water layer. Each face 173 has a central, shallow concavity shown as conical (FIG. 6), but it may advantageously be fashioned by grinding a very shallow indentation of cylindrical shape crossing the element face along a line in the direction of belt travel, forming a concavity in the cylindrical face.

The remainder of each belt bearing 32, such as the upper one in FIGS. 1 and 2, shown also in FIG. 3, is constructed to carry the belt 20 on a water layer, and to that end provides distribution of water through a heavy cylindrically-curved plate portion 194 from an interior chamber 196. Although other aperture arrangements such as heretofore employed in liquid-layer bearings, sometimes called foil bearings, can be employed, the present structure (see also FIGS. 4 and 8) comprises a large multiplicity of relatively wide cylindrical passages 198 through the plate, opening from the chamber 196 via relatively narrow, coaxial apertures 200, whereby the water is kept under fairly high pressure in the chamber 196 and thereby uniformly distributed in sufficient volume through all the passages. For the liquid bearing function, relatively even distribution of water under adequate pressure is here desired at and over the surface of the curved plate 194, rather than rapid, turbulent flow for cooling. In furtherance of uniform distribution of the water over the belt-adjacent face of the plate 194, each of the passages preferably opens through a slightly concave face portion 202 machined in the otherwise cylindrical surface of the plate. Although this concavity 202 for each passage 198 is simply shown as a shallow cone, it may have other shapes such as a shallow zone of spherical surface coaxial with the passage. As shown, the passages 198 are closely distributed throughout the plate 194, in many rows with many passages in each, for instance in staggered relation from row to row as shown.

Suitable arrangement is provided for removal of water from the surface layer around the plate 194 (and also additionally from the region between the nozzle heads 174 and the plate 170), as for example along the circumferential grooves 204 near the edges of the plates 194 and 170 disposed inwardly alongside of the side seal means (described below), and extending completely along the semicylindrical contour of the entire structure 32, up to the mold entrance 24 where each groove is substantially blocked by the transverse seal 158. The bottom of each groove 204 communicates (for withdrawal of water) through passages 205 into a corresponding drain chamber 206 in side structure 207 of the bearing assembly 32, which chamber in turn communicates (by suitable means not shown) with the outlet chamber 186. The plate 194 can conveniently be integral with the plate 170 that carries the cooling elements 172, and as shown each groove or channel 204 extends along the plate section 170, so that it serves to carry the discharge flow of water from the surface of the plate 194 and part of that from the region of plate 170 under the cooling heads 174. All of the discharge flow in the channels 204, either through the passages 205 and the chambers 206 or at the vicinity of the slots 180, eventually joins the further flow from the cooling section in the chamber 186 for ultimate withdrawal therefrom.

Inasmuch as the discharge pressure requirements for maintaining a liquid bearing layer around both the simple bearing and the cooling sections of the structure 32 can be the same, the described arrangement is suitable for removal of water maintained around the entire structure 32. As will be understood, the control of pressure and volume of water supply and withdrawal is such that proper delivery of water under pressure is effected through the openings 200 and the jet apertures 176 and the desired layer of water is maintained throughout the reverse face of the belt with intended characteristics at the several localities, with effective drainage of water from all areas. The conditions governing the state of filling or partial filling of the chambers 178, 196 and 186, and all related passages, are essentially the same as for the corresponding chambers and passages for the cooling pads, as for example in that air leaking into the grooves 204, which are maintained under slight subatmospheric pressure, can reach the chamber 186 and can be similarly managed. For holding each belt throughout its entire path over the plate 194 and the elements 172, its tensioned state in most cases obviates need for subatmospheric pressure at the belt face, e.g. to pull it toward the elements 172, although some such may be provided if desired for optimum removal of water or for other reasons.

As explained above, and shown in FIGS. 3, 4, 5 and 7, the outermost rubber sealing and supporting elements 160 continue around the portions of the side plate structure 82 of the bearing assemblies 32. The latter also include sealing elements, e.g. larger rubber tubes 208 carried in circumferential grooves 209 spaced inwardly of the outer elements 160 (between the latter and the groove 204), and exactly corresponding in location and function to the elements 164 adjacent the cooling pads 80. Thus these further elements 208 can be deemed continuations of the seals 164 and afford primary means for preventing lateral fluuid communication between the liquid bearing layer and the surroundings, throughout the length of the belt path around the structure 32.

Although a transverse seal can be used between the cooling and simple bearing sections, this locality is traversed crosswise by a special distribution strip 210 (FIGS. 2, 3, 7 and 8) bolted to the outer face of the plate 170 (which is depressed below that of the plate section 194) and having its outer surface aligned with that of the plate 194. The underside of the strip 210 has a groove 212 which receives water under pressure from a transverse array of passages 214 that open into the chamber 196. From the groove 212, a multiplicity of very narrow passages 215 carry high velocity water to the locality of the bearing layer on the plate 194 and serve to react against voluminous flow of water in either direction circumferentially of the structure 32, i.e. between the cooling flows over the element faces 173 and the bearing layer over the plate 194. An identical strip 210 is mounted in the plate 194 across its end region 216, where the belt 20 commences its curved path, opposite to the locality 24. This outer strip 210 also receives water through identical passages 214, and injects like, fine, high velocity streams into the bearing water layer, for like barrier effect relative to the latter. The foregoing instrumentalities are identically provided for the lower bearing structure 32 that serves the belt 21, and indeed the latter structure can be in all respects the same as the upper one, in inverted position. As will be appreciated, alternative or further seals or the like can be provided, if desired or found necessary, for the bearing structures 32, for instance across the entire assembly at the locality 216, where the side seal members 208 terminate.

For simple illustration, FIGS. 14 and 15 (taken with other views) show purely schematically a water supply and withdrawal system for the apparatus (exemplified relative to the upper belt carriage), it being understood that actual details of such system in themselves form no part of the present invention and can embody any selection of components of known design suitable for the desired control and distribution functions. Here for example, water can be considered to be supplied at high pressure by a pump 220 in a main conduit 222 from which branch pipes 224, 226, 228 and 230 lead respectively to the chambers 196 (for the primary curved bearing section), 178 (for the curved belt cooling section ahead of the casting space), 136 and 138 (each serving two of the four cooling pads 80), these branch pipes including, if needed, corresponding regulating valves 234, 236, 238 and 240, i.e. to the extent that specific individual pressures are required at the downstream side of each line. Water discharge is provided through the pipes 242, 244, 246, 248 and 250 respectively from the exhaust chamber 186 for the entire curved bearing structure 32, and four separate exhaust chambers 98 for the four cooling pads 80. These discharge pipes may include separate, corresponding valves 252, 254, 256, 258 and 260, to the extent desired or necessary, to regulate the flows for maintaining separate, selected pressures upstream of the valves, i.e. in the several exhaust chambers, and the discharge pipes may all lead to a common discharge conduit 262, shown as including a further pump or other flow-regulating means 264. A like system of supply and discharge pipes can be provided for the lower belt carriage, connected with the same supply and discharge conduits or with separate such elements if desired.

As indicated in FIGS. 1 and 14, there can be (for each of the upper and lower belt systems) a further housing 266 adjacent to the last cooling pad 80 at the exit end 26 of the casting space, containing a single row of cooling nozzles across the belt path, identical in structure and mounting with the cooling elements 102 (FIG. 10), and having provision for high pressure water supply and water withdrawal respectively from the last supply chamber 138 and the last discharge chamber 98. The arrangement (not shown) of these elements is with their heads overlapping the last transverse seal 158, to complete the overlapped coverage of the latter similarly to the other seals and thus to complete the sealed situation of the last pad 80.

It may be explained that where necessary the side plate structures 82 of the belt carriages are sectionalized, for example in that the side plate portions 270 adjacent each drive roll 28 should usually be separate elements aligned with the main side plate sections but mounted and arranged to move with the roll journals such as 52, 60, when the latter are displaced to slacken or tension the belts. The outer seal element 160, passing around the entire belt path, can be sufficiently elastic to accommodate the normal range of adjustment of the plate parts 270.

To illustrate the positioning of the pads 80, as for example to provide a converging taper of the belt paths from entrance 24 to exit 26 of the mold space 22, FIG. 14 is a grossly exaggerated view of such taper as achieved with shims of appropriate thicknesses at the various pad mounting seats described hereinabove. Normally the angle of such required taper (whether achieved by adjusted setting for one belt or for both) is so small as to be incapable of representation in a drawing on this scale, and indeed may be almost imperceptible visually in full-sized apparatus. Nevertheless, the machine is capable of being set, by the described positioning of the pads, to achieve any desired contour, whether tapering or otherwise, of the belt paths as found necessary to produce cast strip of selected thickness with plane, parallel surfaces; the range of contouring necessary for this purpose is relatively small, but has been unattainable, or less than perfectly attainable in many cases, with prior belt supporting and guiding instrumentalities. In practice, the degree of taper may differ along the path, e.g. to account best for shrinkage of the metal during solidification. Furthermore, the resilient, limit-loaded situation of the support elements cooperates with the contoured belt path stabilization, for instance in allowing whatever full extent of taper is required for assured accommodation of metal shrinkage (or even slightly more taper for best such assurance), with the individual guiding elements then yielding, e.g. at places toward the end of the path, for optimum, precise delivery of properly solidified strip having the desired, uniform thickness.

For presently contemplated use of the cooling system along the casting space, the liquid bearing layer, rapidly flowing over localized areas collectively covering essentially the entirety of the reverse surface of the belt by virtue of their close spacing arrangement, is extremely thin, as for example in a range below 0.01 inch, e.g. between 0.001 and 0.005 inch measured between the belt and the flat peripheral region of each nozzle face 106, being a magnitude of such layer which is attainable with supply of coolant (e.g. water) to the interior 112 of each element at a suitable pressure, for instance in the range of 10 to 100 p.s.i. (pounds per square inch). As will be understood, the spacing shown in the drawings as corresponding to this layer is exaggerated for clarity, as is also the depth of the concavity in the nozzle faces, such as the face 106; for example, the angle of this cone to the base plane of the face need not ordinarily be more than a few degrees, e.g. about 1° to 3°. Similar considerations will be understood to apply to the cooling region (plate 170) of each end bearing 32, and if desired, similarly thin layers, or thicker when found necessary, can be employed over the simple hover portion (plate 194) of such bearing supplied with fluid (e.g. water) as above. The foregoing values are given as examples presently deemed suitable, for instance in casting aluminum, but it will be understood that other thicknesses of water layers, e.g. larger but in most cases not more than a small fraction of an inch, and lower or even considerably higher supply pressures can be employed.

As may now be appreciated, one important function of the slight concavity in the nozzle face 106 is to prevent possible inadvertent sticking or sealing of the belt to the face, as may sometimes occur if the smooth reverse surface of the belt comes in contact with an entirely smooth, e.g. plane face of the nozzle element. A slightly concave shape, in the central region, is unusually advantageous in avoiding this difficulty, but it is conceived that other configurations may prevent such sealing (i.e. to insure maintenance of a film of flowing water between the belt and the nozzle), as by merely some roughening of the nozzle face, or shallow grooving across it, or even a slight convexity provided no sealing can occur.

The function of the described cooling nozzles is to be distinguished from that of simple liquid (i.e. so-called foil) bearings. The normal function of a foil bearing (as in the region 194 of the end bearing 32) is to provide a low friction stable bearing which uses a minimum amount of the supporting fluid, for example water. This is usually accomplished by having the supporting fluid moving relatively slowly and causing it to move over relatively long distances before it is either lost or recycled. To use the supporting fluid effectively, the time when it is in the bearing is maximized. The function of the cooling nozzles involves a significant difference; not only must they support the belt but they must also cool it. In order to maximize the cooling effectiveness of the bearing, the supporting (and cooling) fluid must move rapidly over the supported surface, and in order that this fluid shall not become too hot, it must not remain in the bearing for too long. This is accomplished by having many feeding and withdrawal points in the bearing, these points being only a short distance apart. Also, the stand-off between the belt and the nozzles is kept small (e.g. not more than a few hundredths inch and preferably in the above range below 0.01 inch) so that a high velocity of the fluid, for example water, is maintained for a relatively low volume of flow.

These nozzles permit the attainability of a selected repulsive force on the belt through a range down to zero and, if desired, down to a slight negative value, as through the above range of relatively low values of stand-off distance, resulting in high heat transfer coefficients with relatively low total fluid flow rates. In another sense, there is achievement of a high modulus (rate of increase of repulsive force per unit decrease of stand-off) at very small stand-off, leading to belt path stability close to what could be achieved with a solid plate in supporting contact with the belt, yet retaining cooling of 100% of the belt surface by high velocity fluid.

In practice, the significant characteristics of the described bearing-faced nozzle can also be described as such that over a small distance of stand-off, as in the example of a range of a few thousandths of an inch mentioned above, increase of belt stand-off is accompanied by decrease of repulsive force to a negligible value or to a small negative value, and decreasing the stand-off through the range (belt brought closer to the nozzle) causes a rise in repulsive force, more steeply as the lower values are approached, so that the support becomes stiffer and stiffer until the force reaches a safe maximum level at which the limit load feature (of yieldability of the elements) becomes effective to limit (1) the further increase of the force, and more importantly, (2) the decrease of the coolant flow below a safe minimum value. At all operating distances, therefore, an adequate fluid flow is maintained for cooling.

As will be understood, the casting apparatus is preferably constructed and arranged so that the belts are forced outwardly toward the cooling pads as may be necessary to keep them in their paths and to insure proper cooling. In some circumstances or parts of the casting space, such effect may be caused by gravity, e.g. on the lower belt, or in some regions sufficiently by head of the metal, or, for example near the end of the space, by the solidified shells of the metal. Most importantly, if desired, such force can be exerted at any locality by pressure difference between the faces of the belt, independently of the metal; thus if the coolant outlet pressure of a cooling pad is kept below atmospheric, for example by 1 to 5 p.s.i., the belt will be correspondingly forced toward the nozzles collectively.

For illustration, at a higher part of the pressure difference range, the belt may be forced close to the nozzles, say for a stand-off of 0.002 inch or less, with corresponding stiff compliance in support of the belt; for a lower pressure difference, the stand-off may be, for example, 0.004 inch, with relatively soft compliance; if significantly greater force is exerted (as by solid metal), the repulsive force across the liquid layer becomes very high and the resilient loading of the nozzle yields, allowing the nozzle to move outwardly while still keeping a sufficient flow for cooling action. It will be understood, of course, that the repulsive force at the face of each nozzle is the pressure between the nozzle and the belt, and as such, is related to the existence of a pressure difference between the belt-adjacent enclosure of the pad and atmospheric pressure, i.e. the extent of pressure difference between the faces of the belt, which may exert force on the belt toward the nozzles as explained above.

As will be readily understood, there is a necessary relation between the stiffness of each flexible belt (governed by thickness among belts of like composition such as a selected steel) and the spacing between adjacent supports, i.e. the nozzle elements considered as abutted by the belt through the liquid layer. A belt which is not stiff enough to bridge the spaces between adjacent supports without sagging to an extent impairing the desired contact with the metal at some stage in freezing is clearly too limp, and likewise a belt must not be so stiff that its own resistance to deflection defeats the function of compliance and resilient loading at the nozzle elements. Meeting these requirements is easily determinable for any selected belt composition, indeed, for example, steel belts presently conventional for twin belt casters are generally suitable for the machine here shown.

The operation of the apparatus will be readily apparent from all of the foregoing. Molten metal is supplied to a deep pool in the inlet launder 70 where it is quieted as it feeds against the belts 20, 21, converging in their curved paths to the actual casting zone entrance 24. It enters there as a substantially parallel-faced liquid body (with any actual, slight converging taper of the belts if and as desired), and in its carriage through the casting zone 22 to the exit becomes progressively solidified from its upper and lower faces inward, until it is delivered as continuous, solid, cast strip.

The cooling efficiency of the described cooling pads 80 is extremely high, and correspondingly both the surface and internal characteristics of the cast product are very good. The pads can be employed, as by adjusting a coolant outlet pressure control system, to maintain a significantly subatmospheric pressure next to the reverse belt surfaces, for exerting corresponding force at all localities, thereby drawing each belt toward all the cooling elements 102, e.g. in effect against them through the intervening liquid layer. Thus the moving belts are stabilized in the precise paths desired, as defined by the collective faces 106 of the nozzle elements 102. The liquid layer itself provides a small degree of compliance, i.e. yieldability, and substantial compliance or yielding is afforded by the limit-loaded supports, all to the effect that the belts, while stabilized against the supporting system, locally maintain optimum contact with the metal throughout.

The extent of compliance of both kinds can be adjusted or preset as may be desired for a wide variety of casting conditions. Indeed the various degrees of compliance cooperate in preventing local failures of cooling (and even minor breakouts of unsolidified metal) and in preventing incipient gaps between the belt and the metal. Localities of even slightly greater metal shell thickness and outward force on the belt can be accommodated by the described compliance, without the belt beginning to bridge adjacent localities (such bridging or other gap can cause progressive loss of cooling or even progressive thermal distortion of the solidifying shell away from the belt at some localities); the belt is generally stabilized in its path, yet remains in good contact with the metal at all places.

In consequence of all these features, high quality cast strip is attainable with uniformity, at higher speeds and for all gauges from very thin to thick, and with a wide variety of metal compositions, including alloys heretofore difficult or impossible to cast continuously. The invention fully achieves each and all of the objectives, advantages and new results hereinabove set forth or contemplated.

It is to be understood that the invention is not limited to the specific structures and procedures herein shown and described, but may be carried out in other ways without departing from its spirit.

We claim:

1. An apparatus comprising, in combination with means providing a surface which moves in a desired path and which is to be cooled: a multiplicity of elements having closely spaced faces lying in and distributed throughout a non-traveling surface which substantially conforms with said path over a predetermined area and which is arranged so as to provide a slight spacing between said non-traveling and said moving surfaces, each of said elements having a central jet aperture through its face for directing liquid coolant against the moving surface, and means for supply of liquid coolant under pressure to the jet apertures and for withdrawal of liquid coolant from spaces between the element faces, said elements and said coolant supply and withdrawal means being constructed and arranged so that liquid coolant flows outward from each jet of the elements against and in covering relation to the moving surface, forming a coolant layer filling the slight spacing between the element faces and the moving surface, and is withdrawn through the said spaces between the element faces; said apparatus further including means for mounting each of said elements to be movable individually toward and away from the aforesaid predetermined path, and means loading each element toward said path, said loading means being resiliently yieldable so that each element can be individually moved in the direction away from said path upon displacement of the moving surface in said direction, exerting force through said coolant layer against the face of the element.

2. Apparatus as defined in claim 1, in which the means providing a moving surface comprises means advancing a flexible band so that at least one of its surfaces constitutes the aforesaid surface to be cooled.

* * * * *